US010661814B2

(12) United States Patent
Huck et al.

(10) Patent No.: US 10,661,814 B2
(45) Date of Patent: May 26, 2020

(54) AUTO RACK CAR CONVERSIONS AND DECK ADJUSTMENTS

(71) Applicant: Trinity North American Freight Car, Inc., Dallas, TX (US)

(72) Inventors: Kenneth W. Huck, Fairview, TX (US); Jerry W. Vande Sande, Dallas, TX (US); Brant R. McGhee, Arlington, TX (US)

(73) Assignee: TRINITY NORTH AMERICAN FREIGHT CAR, INC., Dallas, TX (US)

( * ) Notice: Subject to any disclaimer, the term of this patent is extended or adjusted under 35 U.S.C. 154(b) by 0 days.

(21) Appl. No.: 16/193,800

(22) Filed: Nov. 16, 2018

(65) Prior Publication Data

US 2019/0176851 A1 Jun. 13, 2019

Related U.S. Application Data

(62) Division of application No. 15/206,876, filed on Jul. 11, 2016.

(60) Provisional application No. 62/289,666, filed on Feb. 1, 2016.

(51) Int. Cl.

| | |
|---|---|
| ***B61D 3/18*** | (2006.01) |
| ***B61D 3/04*** | (2006.01) |
| ***B61D 3/02*** | (2006.01) |
| ***B61D 3/00*** | (2006.01) |

(52) U.S. Cl.

CPC ..... *B61D 3/04* (2013.01); *B61D 3/005* (2013.01); *B61D 3/02* (2013.01); *B61D 3/18* (2013.01); *B61D 3/187* (2013.01)

(58) Field of Classification Search

CPC ..... B60R 13/04; B60R 19/44; B60R 19/42; B60R 13/043; B60R 19/445; B60R 2011/0057; B60J 11/06; B60J 11/025; B61D 3/005; B61D 3/02; B61D 3/04; B61D 3/18; B61D 3/187

See application file for complete search history.

(56) References Cited

U.S. PATENT DOCUMENTS

| | | | | |
|---|---|---|---|---|
| 4,810,015 A * | 3/1989 | McNeil | B60J 11/06 | 150/166 |
| 5,129,695 A * | 7/1992 | Norman, II | B60J 11/06 | 280/770 |
| 5,239,933 A * | 8/1993 | Murphy | B60P 3/08 | 105/374 |
| 7,976,255 B2 * | 7/2011 | Anderson | B61D 3/188 | 410/30 |
| 2010/0276951 A1 * | 11/2010 | Malina | B60R 19/44 | 293/142 |
| 2014/0123872 A1 * | 5/2014 | Zaerr | B61D 3/18 | 105/355 |

* cited by examiner

*Primary Examiner* — Mark T Le

(74) *Attorney, Agent, or Firm* — Baker Botts, LLP

(57) ABSTRACT

An apparatus includes a panel, a fastener, and a cushion. The panel is coupled to a side of a railcar. The fastener engages the panel. A vertical position of the fastener on the panel is adjustable. The cushion is coupled to the fastener. The cushion extends from the side of the railcar towards an interior of the railcar and prevents the side of the railcar from contacting an object stored in the railcar.

6 Claims, 22 Drawing Sheets

AUTO RACK CAR CONVERSIONS AND DECK ADJUSTMENTS

RELATED APPLICATION

This application is a divisional application of U.S. patent application Ser. No. 15/206,876 filed Jul. 11, 2016 and entitled "AUTO RACK CAR CONVERSIONS AND DECK ADJUSTMENTS," which claims priority to and the benefit of U.S. Provisional Patent Application No. 62/289,666, filed Feb. 1, 2016, and entitled "AUTO RACK CAR CONVERSIONS AND DECK ADJUSTMENTS," all of which are hereby incorporated by reference in their entirety.

TECHNICAL FIELD

This disclosure relates generally to configuring an Auto Rack car.

BACKGROUND

Auto Rack cars are a type of railcar configured to store and transport automobiles and/or vehicles (e.g., cars, trucks, motorcycles, etc.). Existing Auto Rack cars may be configured with one deck, (Uni-level), two decks, (Bi-level), or three decks, (Tri-level). Some of these existing Auto Rack cars are convertible from two decks to three decks or from three decks to two decks. Conversions may be performed to accommodate different sized vehicles, such as taller vehicles that may not fit on a Tri-level Auto Rack car. However, the conversion process is cumbersome and expensive, and therefore, is not performed frequently. Converting an Auto Rack car may take over 100 man-hours and may involve major mechanical work, such as removing the Auto Rack deck(s), roof and doors. Other existing approaches involve removing the unused deck from the Auto Rack car.

In existing Auto Rack cars, deck heights determine the maximum height of auto vehicle the Auto Rack deck can transport. Deck heights are generally set and not moved due to difficulty and expense. Deck adjustments may be performed at a distant facility, which requires scheduling and having the Auto Rack car out of service for the duration of the conversion. These adjustments may increase the expense to the shipper and limits the flexibility of the shipper to manage loading efficiency. These adjustments may also require careful scheduling of Auto Rack cars with the correct deck heights to accommodate a given shipment. Further, in order for an Auto Rack car to be compatible with other Auto Rack cars, the decks may have to be located in certain positions or within some tolerance (e.g. plus or minus 3 inches) of the other Auto Rack cars.

Existing Auto Rack cars are about 19 feet in height, and meeting AAR Plate "J" and the Tri-level Auto Rack deck locations limit the population of vehicles that can be loaded into the Auto Rack car due to limited vertical clearance between the decks. Increasing the height of the Auto Rack, for example, to meet the requirements of AAR Plate "K," provide additional deck spacing and could permit the transporting of taller vehicles. However, increasing the height of the Auto Rack car may not be permitted in some places due to clearance with tunnels, bridges, and other objects.

Protective strips or door edge guards attach to the inside of an Auto Rack car at the door level and protect vehicles loaded into an Auto Rack car from hitting and/or scratching against an interior surface of the Auto Rack car. Existing door edge guards are permanently or semi-permanently attached to the inside of the Auto Rack car using various fasteners such as plastic expanding fasteners that protrude through holes in the Auto Rack side sheets. However, these fasteners may only allow for a finite number of predetermined locations for the door edge guards. Furthermore, attaching the door edge guards may require numerous fasteners along the length of both sides of the Auto Rack car, which may be eighty feet or more in length, and for each deck in the Auto Rack car. These fasteners may not be reusable, and therefore, may need to be replaced when the door edge guards are relocated.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1A:
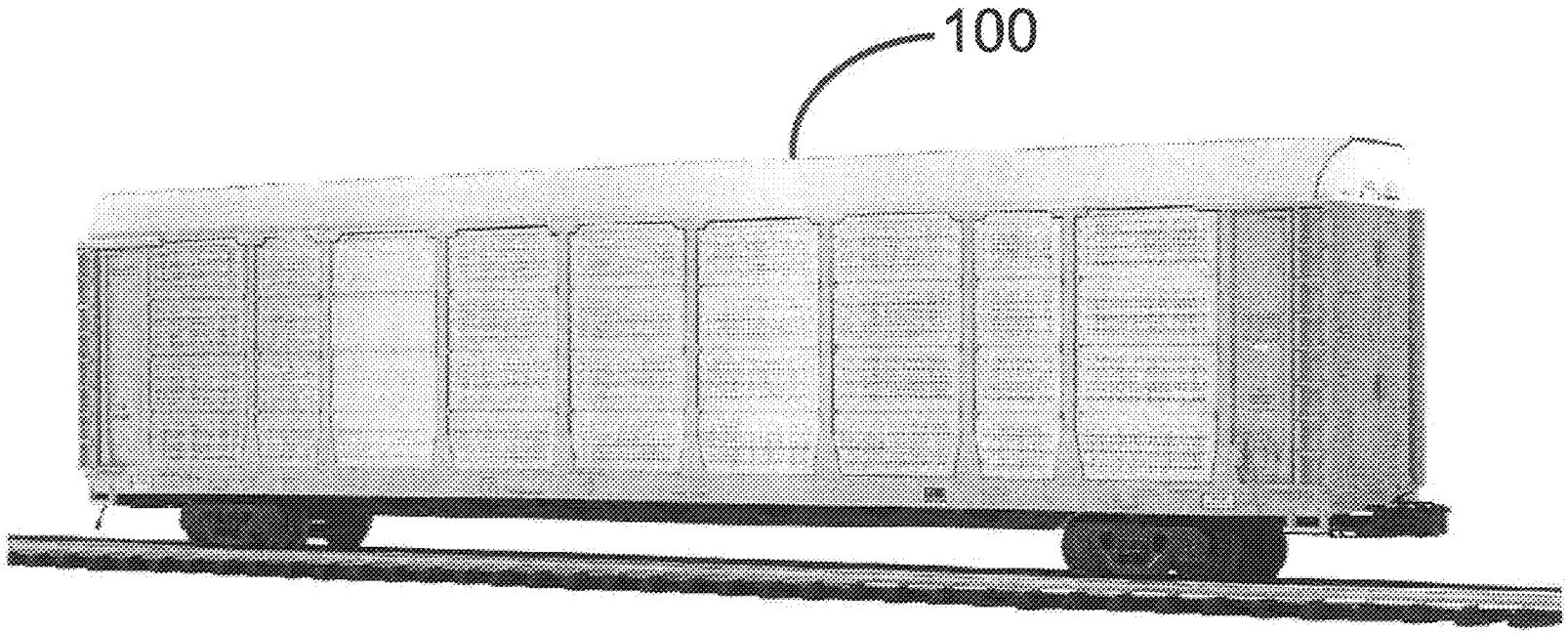
FIG. 1A is a side view of an embodiment of an Auto Rack car.
Figure 1B:
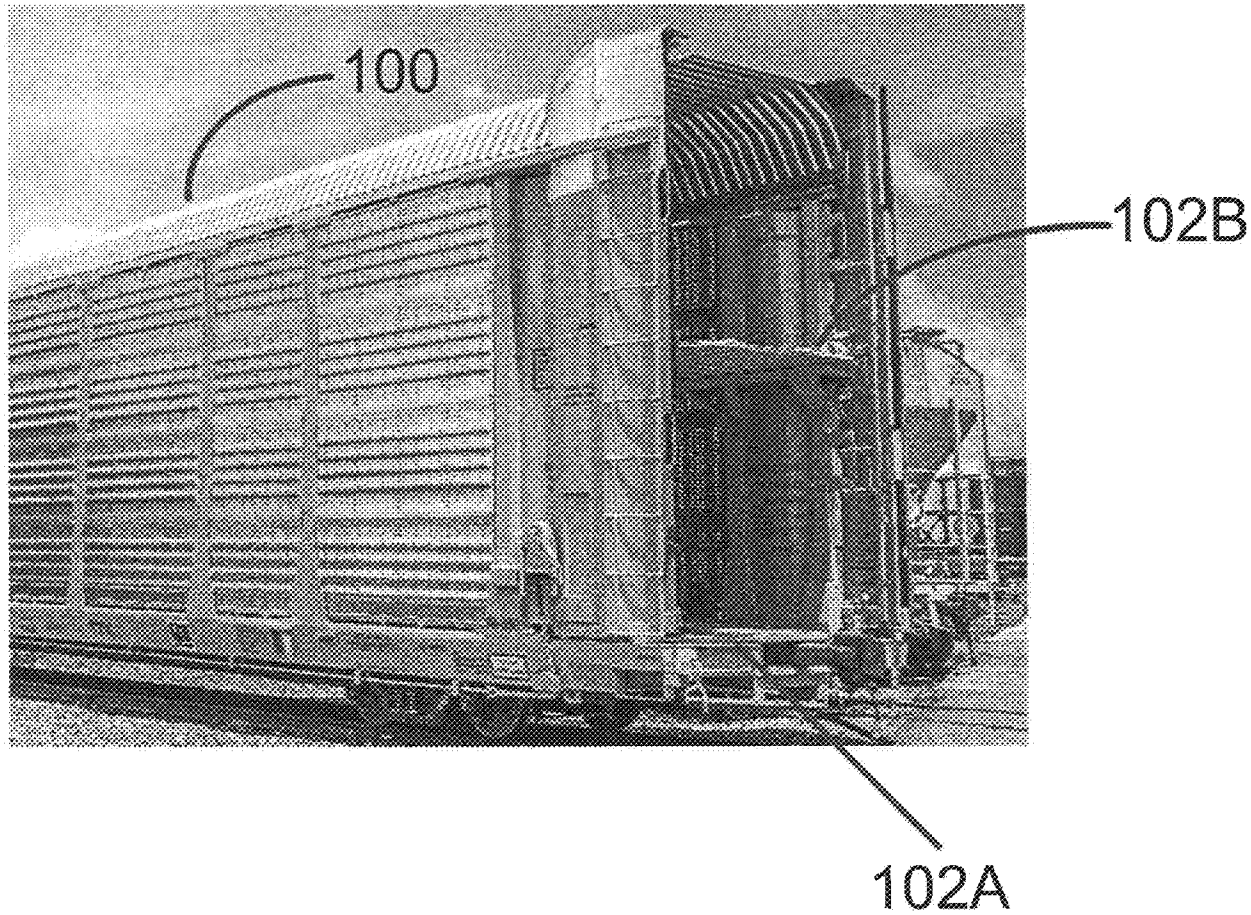
FIG. 1B is an end view of an embodiment of an Auto Rack car.

Auto Rack cars are a type of railcar used to store and transport vehicles (e.g., cars, trucks, motorcycles, etc.). FIG. 1A illustrates a side view of an embodiment of an Auto Rack car 100. Vehicles are loaded into the Auto Rack car 100 and transported by railway to their destination. Existing Auto Rack cars 100 may contain decks at different heights on which vehicles can be stored. By using these decks, more vehicles can be loaded into an Auto Rack car 100. FIG. 1B illustrates an end view of an embodiment of an Auto Rack car 100. In the illustrated embodiment of FIG. 1B, Auto Rack car 100 includes two decks 102A and 102B. This disclosure contemplates Auto Rack car 100 including any number of decks (e.g. three or more decks). The decks of an Auto Rack car may be referred to as an A-deck, a B-deck, a C-deck, and so forth based on their position with the Auto Rack car. The floor or lowest level of the Auto Rack car is referred to as the A-deck (labeled 102A in FIG. 1A). The level or deck above the A-deck is the B-deck (labeled 102B in FIG. 1A). The level or deck above the B-deck is the C-deck, and so forth.

In existing Auto Rack cars, once the decks are positioned in the Auto Rack car, the decks may be difficult to remove and/or adjust. Furthermore, it may also be difficult to adjust a height of the existing Auto Rack cars. Existing Auto Rack cars also include door guards coupled to an interior side wall of the Auto Rack car. These door guards protect the vehicles inside the Auto Rack car from getting damaged by collisions with the side wall of the Auto Rack car. However, once positioned, these door guards are difficult to remove and/or adjust to accommodate different types of vehicles.

Disclosed herein are various embodiments for configuring decks in an Auto Rack car 100. An Auto Rack car 100 may be configured or reconfigured for different vehicles by adjusting the vertical position of decks within the Auto Rack car 100, by converting the Auto Rack car 100 between a Tri-level configuration and a Bi-level configuration, by increasing the overall height of the Auto Rack car 100, and/or a combination of both. Magnetically coupled door edge guards may also be employed to support various configurations of the Auto Rack car 100.

In one embodiment, the vertical position of decks in an Auto Rack car 100 may be adjusted without disassembling portions of the Auto Rack car 100. Each deck may be raised or lowered within the Auto Rack car 100 to accommodate a variety of load combinations. The ability to adjust the vertical position of decks in an Auto Rack car 100 may permit a shipper to easily adjust deck heights to maximize loading efficiency without having to move the Auto Rack car 100 into a maintenance shop, and may provide a means to adjust deck heights to match that of an adjacent Auto Rack car 100 making Auto Rack cars 100 with this design compatible.

In one embodiment, Auto Rack cars 100 may be reconfigured between a Tri-level configuration (three decks) and a Bi-level configuration (two decks) without disassembling portions of the Auto Rack car 100 and/or without removing or adding decks. The decks may be reconfigured and repositioned to allow the Auto Rack car 100 to change its configuration. A reconfigurable Auto Rack car 100 may allow for quick and easy conversions, which may reduce costs, time, and the need to move the Auto Rack car into a maintenance shop. Further, a reconfigurable Auto Rack car 100 will improve the overall loading efficiency of the Auto Rack car for the shipper in one embodiment.

In one embodiment, the overall height of an Auto Rack car 100 is adjustable. The height of the Auto Rack car 100 may be increased or decreased to accommodate a variety of loads and applications. For example, the height of the Auto Rack car 100 may be increased from AAR plate "J" to plate "K" to allow the Auto Rack car 100 to carry taller vehicles. The Auto Rack car 100 may then be converted back to the original height or a lower height as designed when the additional clearance is no longer needed. An Auto Rack car 100 with an adjustable height may eliminate the need to purchase multiple Auto Rack cars 100 with different heights to maximize loading efficiency. Further, an Auto Rack car 100 with an adjustable height may provide flexibility for the shipper to adjust the railcar for vehicle heights quickly near the loading facility to improve efficiency and may increase the routes over which the Auto Rack car 100 can be shipped by allowing it to be able to run over routes with lower clearances.

In one embodiment, door edge guards are repositionable within the interior of an Auto Rack car 100 to protect vehicles inside the railcar from damage caused by collisions with the side walls of the railcar. The door edge guard employs a magnetic coupling to the Auto Rack car 100 which allows the door edge guards to be easily and quickly repositioned anywhere inside of the Auto Rack car 100. A magnetic coupled door edge guard may provide easy adjustability to any height. Furthermore, the door edge guard may comprise a reflective stripe to help guide vehicle drivers through the railcar, which can provide reflected light that illuminates the work areas where the wheel chocks are applied and removed.

Figure 1C:
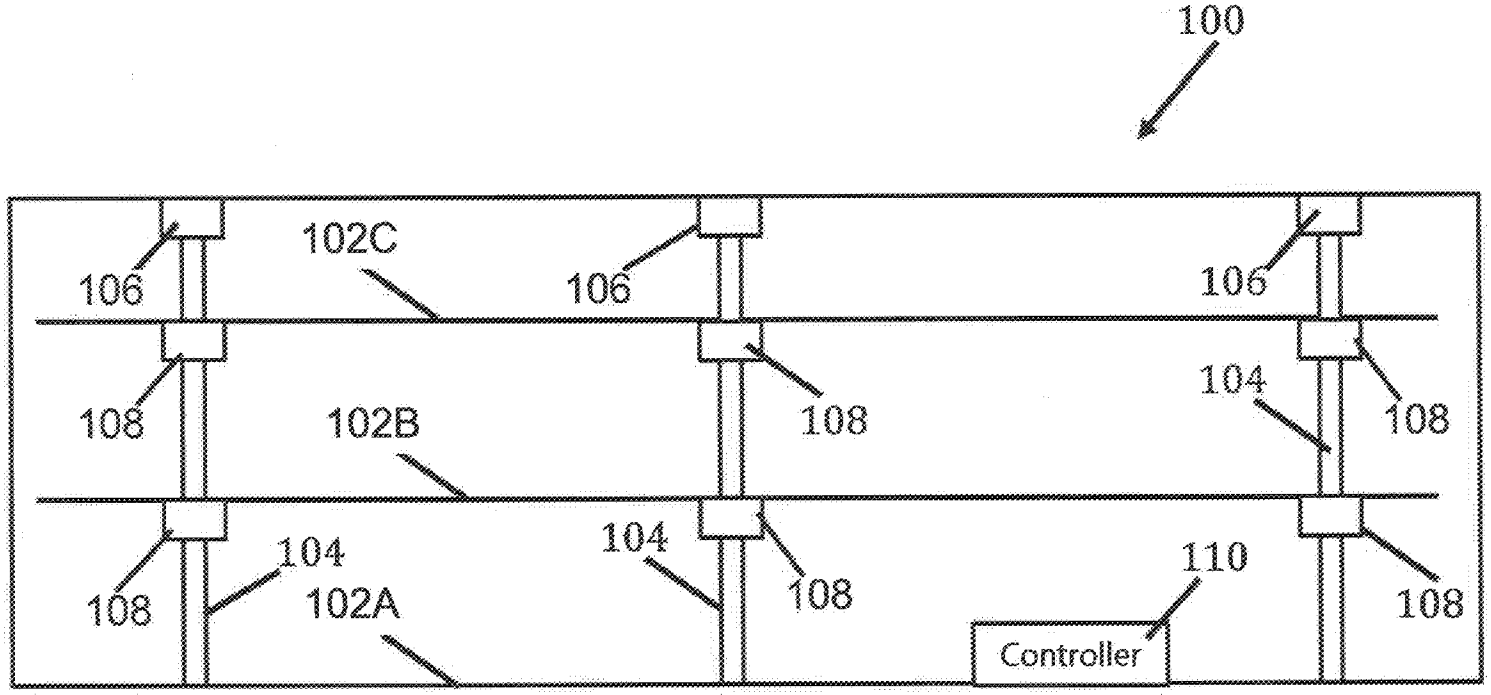
FIG. 1C is a cutaway side view of an embodiment of an Auto Rack car with repositionable decks.

FIG. 1C is a cutaway side view of an embodiment of an Auto Rack car 100 with repositionable decks 102B and 102C. In one embodiment, the Auto Rack car 100 is configured to allow the deck heights to be easily and quickly adjusted by incremental amounts using an adjustment system without having to move the Auto Rack car 100 to a maintenance shop and/or without having to remove decks 102B and 102C from Auto Rack car 100. The vertical position of decks 102B and 102C with respect to the Auto Rack car 100 may be adjusted incrementally, for example, within plus or minus 3 inches, while maintaining pool compatibility and providing an extra clearance (e.g. one or two inches) where needed to accommodate vehicles of different heights. Decks 102B and 102C may be adjusted to heights which allow the Auto Rack car 100 to be compatible with deck heights of other Auto Rack cars in the same train. In one embodiment, a deck 102B or 102C may be "unlocked" (e.g. unbolted or mechanically uncoupled) from the side structure of the Auto Rack car 100, repositioned to a new position, and "re-locked" (e.g. bolted or mechanically coupled) to the side structure of the Auto Rack car 100. When deck 102B or 102C is locked to the side structure of the Auto Rack car 100, a vertical position of the deck 102B or 102C within the Auto Rack car 100 cannot be adjusted. Decks 102B or 102C may be supported and/or repositioned by a variety of techniques, including, but not limited to, cranes, hoists, jacks, chain/cable hoists, hydraulic or air cylinders, and levers.

A vertical position of deck 102A may be adjusted using similar processes to adjust a vertical position of deck 102B or 102C in particular embodiments. In some embodiments, deck 102A is a floor of Auto Rack car 100 and a vertical position of deck 102A cannot be adjusted. In some embodiments, a vertical position of deck 102A can be adjusted.

In one embodiment, the adjustment system may be a Ball screw system that includes Ball screws 104, Ball screw actuators 106, a travelling nut 108, and a controller 110. A Ball screw actuator 106 may be attached to the roof section of the Auto Rack car 100 and may be controlled by controller 110. The controller 110 is operably coupled to the Ball screw actuator 106, and is configured to communicate electrical signals for positioning decks 102B and 102C. The Ball screw 104 is operably coupled to the Ball screw actuator 106 and configured to be rotated by the Ball screw actuator 106 through a gear reduction mechanism and an electric motor or any other rotational system. The travelling nut 108 may be operably coupled to deck 102B or 102C and Ball screw 104 and configured to move along the Ball screw 104 when the Ball screw 104 is turned. The direction of travel of the travelling nut 108 depends upon the direction the Ball screw 104 is turned. Using the Ball screw 104 and travelling nut 108, the deck 102B and 102C can be moved anywhere along the Ball screw 104. The position of the deck 102B or 102C may only be limited by the length of the Ball screw 104 and the clearances within the Auto Rack car 100.

In one embodiment, the travelling nut 108 may be configured to be removable from the Ball screw 104. For example, the travelling nut 108 may be permanently attached to the deck and have a clamp structure that allows the travelling nut 108 to be clamped to the Ball screw 104 to position deck 102B or 102C. The travelling nut 108 may be unclamped and removed from the Ball screw 104 once the deck 102B or 102C is positioned and secured to the Auto Rack car 100. In this manner, it is possible to reduce the number of travelling nuts 108 used in Auto Rack car 100. For example, each Ball screw 104 may have only one travelling nut 108 that is moved between decks 102B and 102C depending on which deck 102B or 102C is being adjusted. In another embodiment, the travelling nut 108 may not be removable from the Ball screw 104 and may remain on the Ball screw 104.

Deck 102B or 102C may be held in position by a brake on the Ball screw 104 and/or a locking system between the deck 102B or 102C and the side structure of the Auto Rack car 100. Multiple Ball screw systems may be used to provide enough lifting capacity, redundancy, and to maintain the deck level during movement. In one embodiment, the deck 102B or 102C may be comprised of multiple sections that can be moved individually or in unison (e.g., a vertical position of one portion of deck 102B or 102C may be adjusted independently of a vertical position of another portion of deck 102B or 102C). The Ball screw system may be configured to reposition a deck 102B or 102C while the deck 102B or 102C is unloaded or loaded, for example, with a vehicle.

A Ball screw system may comprise any number of Ball screws 104 and travelling nuts 108. For example, in one embodiment each deck 102B or 102C may be configured to couple with four Ball screws 104 and four travelling nuts 108 with a Ball screw 104 and a traveling nut 108 at each corner of the deck 102B or 102C. In another embodiment, each deck 102B or 102C may be configured to couple with six Ball screws 104 and six travelling nuts 108 with a Ball screw 104 and a traveling nut 108 at each corner of the deck 102B or 102C and a pair of Ball screws 104 and travelling nuts 108 supporting a mid-portion of the deck 102B or 102C. The Ball screws 104 and travelling nuts 108 may be positioned anywhere along the deck and any suitable configuration of Ball screws 104 and travelling nuts 108 may be employed as would be appreciated by one of ordinary skill in the art upon viewing this disclosure.

Figure 2:
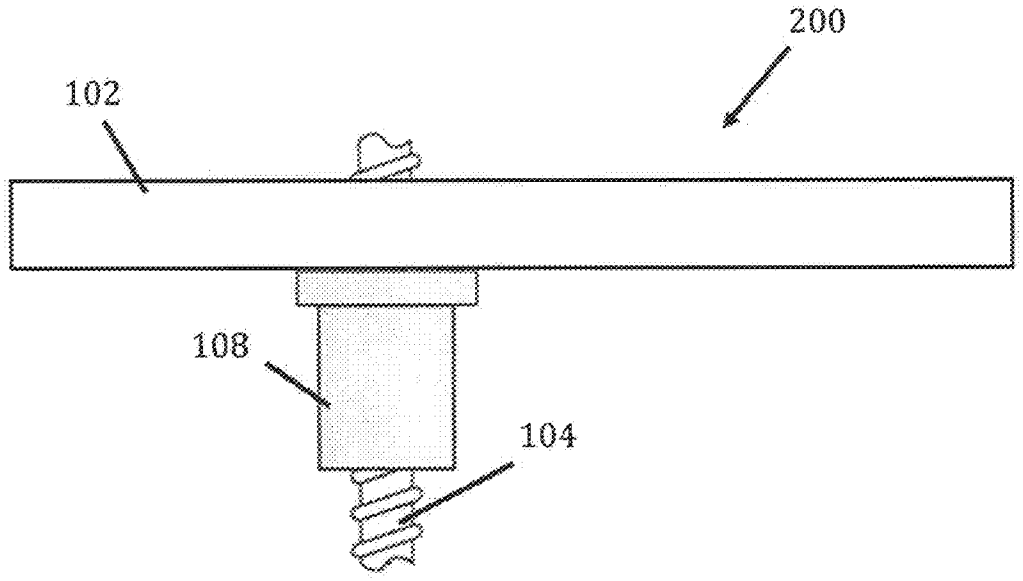
FIG. 2 is a side view of an embodiment of a portion of a Ball screw system for repositioning a deck.

FIG. 2 is a side view of an embodiment of a portion 200 of a Ball screw system for repositioning a deck 102B or 102C. FIG. 2 illustrates the deck 102B operably coupled to the travelling nut 108. The travelling nut 108 is configured to traverse along the Ball screw 104 to move the deck 102B in an upward or downward direction to position the deck 102B. A similar configuration may be implemented for deck 102C.

Figure 3:
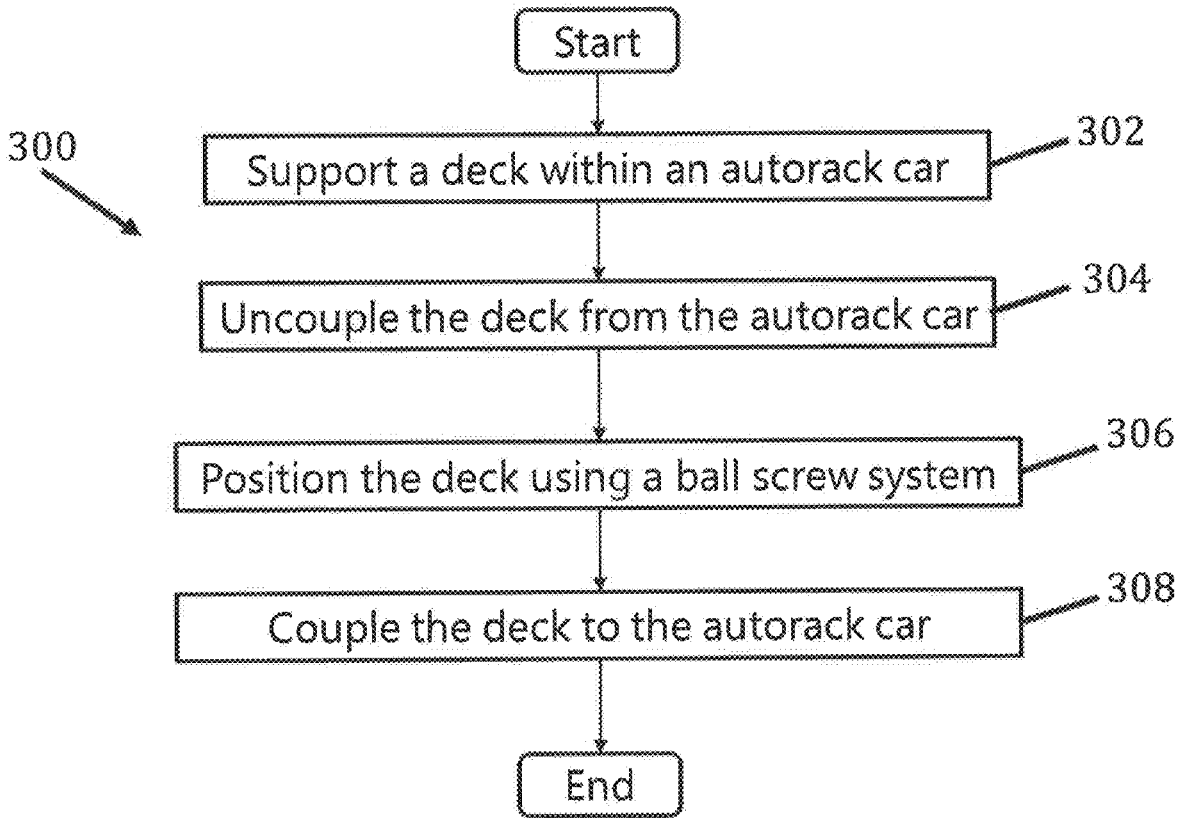
FIG. 3 is a flowchart of an embodiment of a deck height adjustment method.

FIG. 3 is a flowchart of an embodiment of a deck height adjustment method 300. Method 300 may be employed by an operator or technician to adjust the position of a deck in an Auto Rack car 100. At step 302, the operator supports the deck within the Auto Rack car 100. The deck may be supported by a variety of techniques, including, but not limited to, cranes, hoists, jacks, cable hoists, hydraulic or air cylinders, air bags, and levers. For example, a jack may be employed to support the weight of the deck to relieve the tension on the fasteners that couple the deck to the Auto Rack car 100.

At step 304, the operator uncouples the deck from the Auto Rack car 100. The operator may remove fasteners (e.g. bolts or pins) that are used to couple the deck to the Auto Rack car 100. At step 306, the operator positions the deck using a Ball screw system. The operator may move the deck using a Ball screw system that comprises a Ball screw 104, a Ball screw actuator 106, and a travelling nut 108 similar to as describe in FIG. 1. For example, the operator positions a plurality of travelling nuts 108 to support the deck and to couple the deck to the Ball screw 104. The operator may rotate the Ball screw 104 using a controller 110 and a Ball screw actuator 106 to move the deck vertically along the axis of the Ball screw 104. The operator thereby raises or lowers the deck into a new position. Alternatively, the deck may be lowered using any other suitable technique. At step 308, the operator couples the deck to the Auto Rack car 100. The operator may use fasteners (e.g. bolts or pins) to couple the deck to the Auto Rack car 100. When the deck is coupled to the Auto Rack car 100 by fasteners, the fasteners prevent adjustment of the vertical position of the deck within the Auto Rack car 100.

Figure 4:
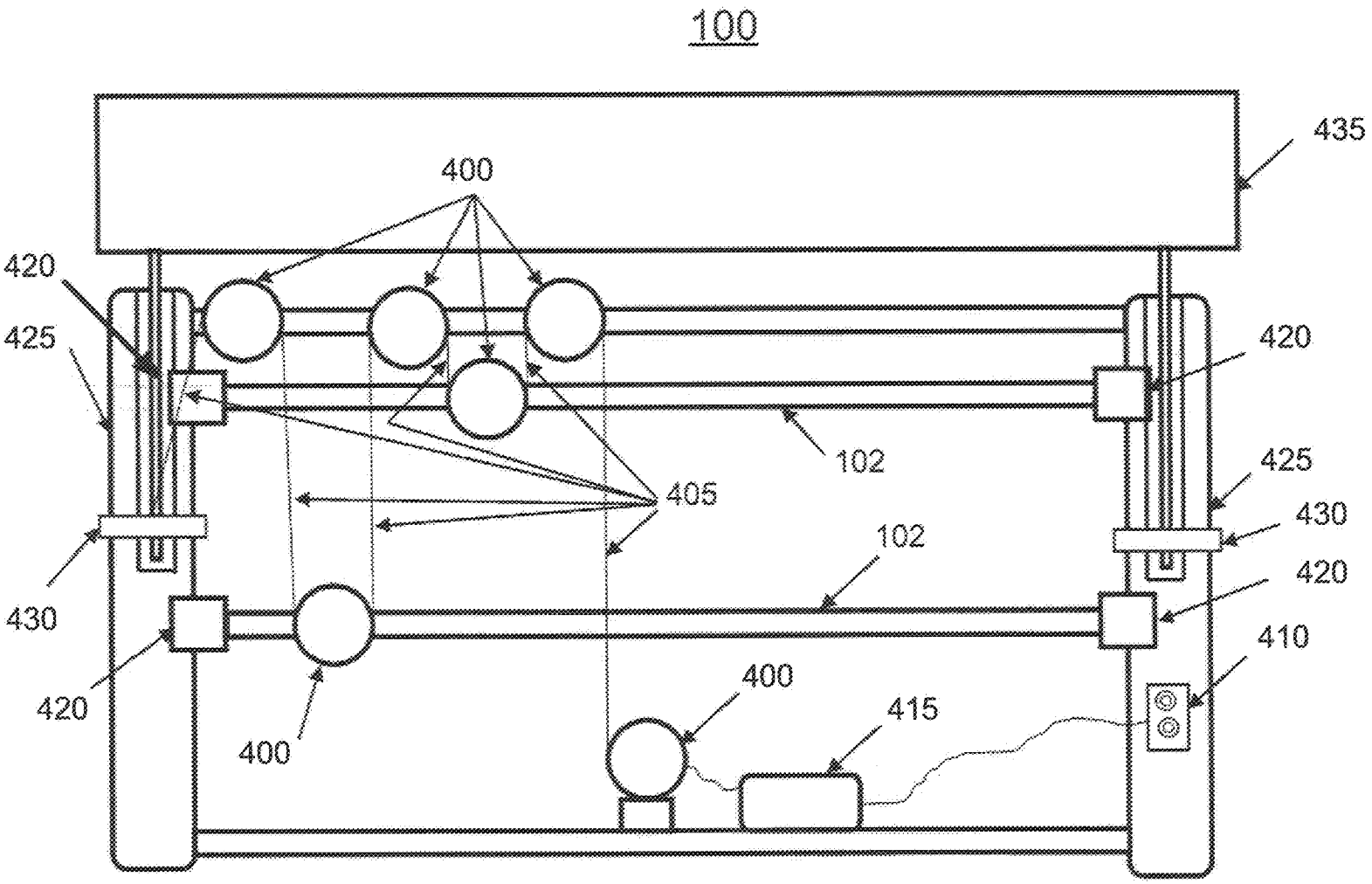
FIG. 4 is a cutaway side view of an embodiment of an Auto Rack car with repositionable decks.

FIG. 4 is a cutaway side view of an embodiment of an Auto Rack car 100 with repositionable decks 102B or 102C. Each deck 102B or 102C is coupled to an adjustment system that includes pulleys 400 and tension elements 405. Tension elements 405 may be any element operable in conjunction with pulleys 400 (e.g., strings, ropes, tethers, straps, cables, etc.). By increasing the tension in tension elements 405 (e.g., by pulling on tension elements 405), the vertical position of deck(s) 102B or 102C may be adjusted. An operator may increase the tension on tension elements 405 by operating buttons 410, which in turn operate an actuator (e.g., motor) 415 that pulls and/or releases tension elements 405 to increase and/or decrease tension on tension elements 405.

Also illustrated in FIG. 4 are fasteners 420 that couple decks 102B and 102C to a sidewall 425 of Auto Rack car 100. These fasteners may lock and unlock decks 102B and 102C from the sidewall 425 of Auto Rack car 100 as described above. The adjustment system of FIG. 4 also includes an adjuster 430 that can adjust a vertical position of a roof section 435 of Auto Rack car 100. Adjuster 430 will be described in more detail using FIGS. 14 and 15.

Figure 5:
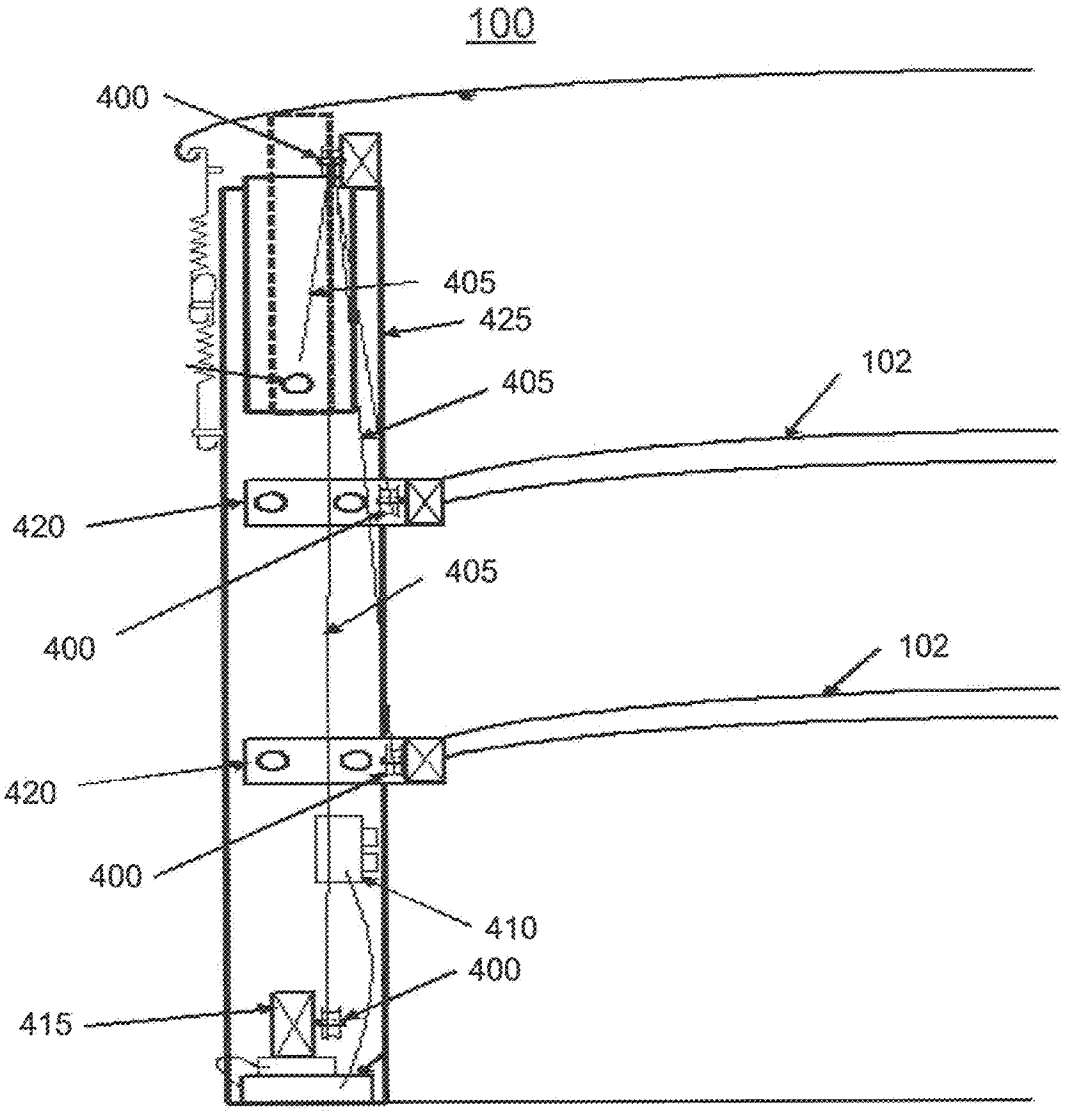
FIG. 5 is a cutaway side view of an embodiment of an Auto Rack car with repositionable decks.

FIG. 5 is a cutaway side view of an embodiment of an Auto Rack car 100 with repositionable decks 102B and 102C. Similar to the embodiment of FIG. 4, a vertical position of decks 102B and 102C may be adjusted using pulleys 400, tension elements 405, buttons 410, and actuator 415. Furthermore, decks 102B and 102C are coupled to a sidewall 425 of Auto Rack car 100 by fasteners 420.

Figure 6:
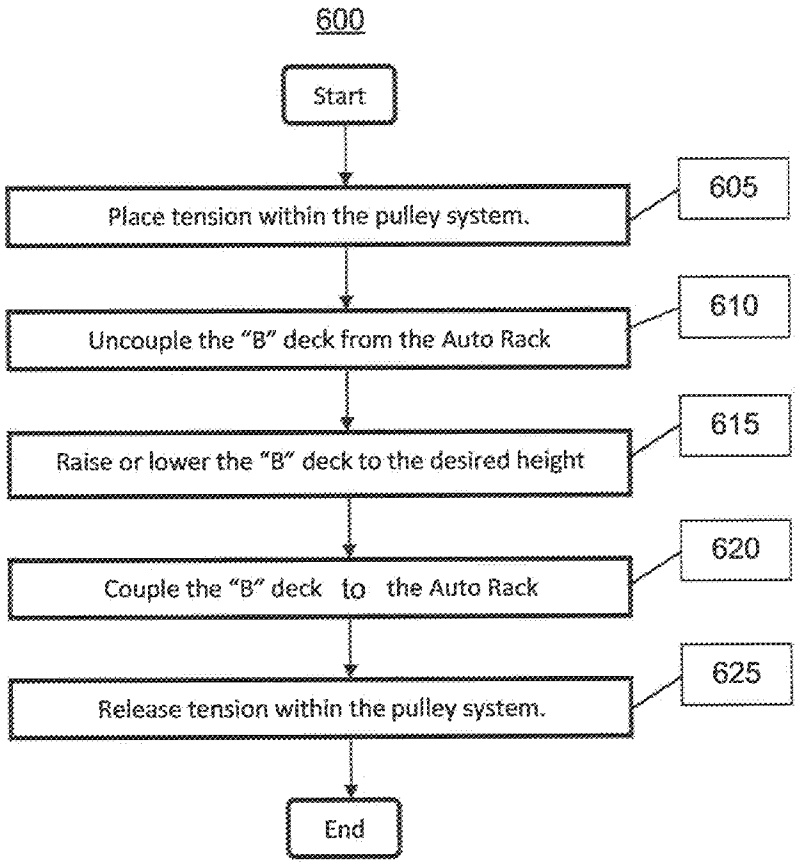
FIG. 6 is a flowchart of an embodiment of a deck height adjustment method.

FIG. 6 is a flowchart of an embodiment of a deck height adjustment method 600. Method 600 may be employed by an operator or technician to adjust the position of a B-deck in an Auto Rack car 100. In step 605, the operator places tension within a pulley system. The operator may place tension within the pulley system by operating buttons and a motor and/or by pulling on tension elements of the pulley system. In step 610, the operator uncouples a deck from the Auto Rack car. The operator may uncouple a B-deck from the Auto Rack car in step 610. The operator may uncouple the B-deck by unlocking or opening a fastener that couples the B-deck to the Auto Rack car.

In step 615, the operator raises or lowers the B-deck to a desired height. The operator may adjust the vertical position of the B-deck by operating the pulley system as described above. In step 620, the operator couples the B-deck to the Auto Rack car (e.g., by locking and/or closing a fastener that couples the B-deck to the Auto Rack car). In step 625, the operator releases tension within the pulley system.

Figure 7:
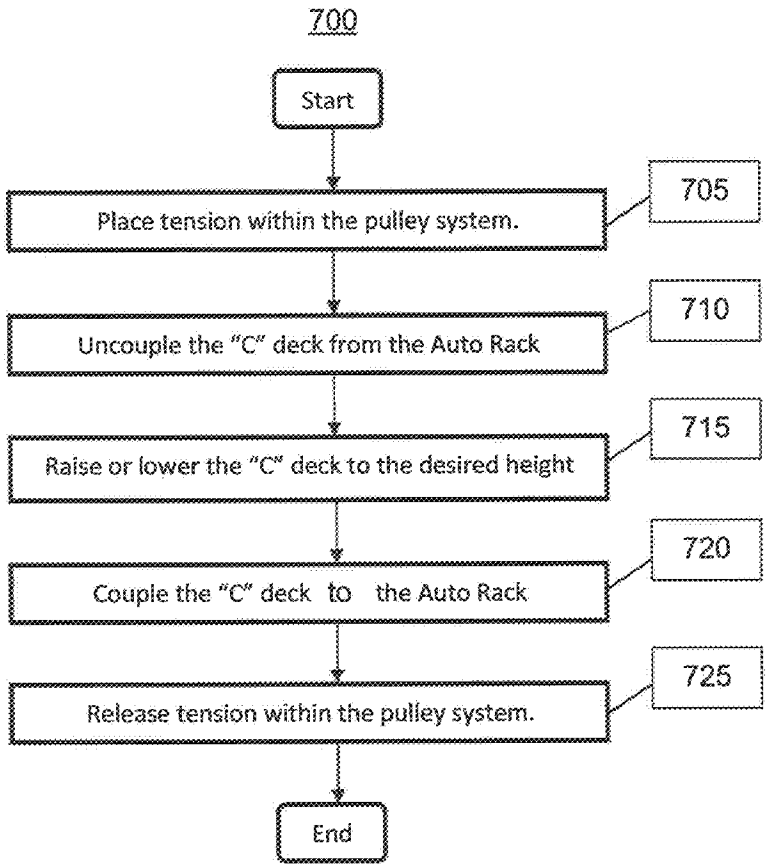
FIG. 7 is a flowchart of an embodiment of a deck height adjustment method.

FIG. 7 is a flowchart of an embodiment of a deck height adjustment method. Method 700 may be employed by an operator or technician to adjust the position of a C-deck in an Auto Rack car 100. In step 705, the operator places tension within the pulley system. The operator may place tension within the pulley system by operating buttons and a motor and/or by pulling on tension elements of the pulley system. In step 710, the operator uncouples a C-deck from the Auto Rack car. The operator may uncouple the C-deck by unlocking or opening a fastener that couples the C-deck to the Auto Rack car.

In step 715, the operator raises or lowers the C-deck to a desired height. The operator may adjust the vertical position of the C-deck by operating the pulley system as described above. In step 720, the operator couples the C-deck to the Auto Rack car (e.g., by locking and/or closing a fastener that couples the C-deck to the Auto Rack car). In step 625, the operator releases tension within the pulley system.

FIGS. 8-11 are cutaway side views of an embodiment of deck configurations in an Auto Rack car 100. In one embodiment, an Auto Rack car 100 may be reconfigured between a Tri-level (three levels) configuration and a Bi-level (two level) configuration. Reconfiguring the Auto Rack car 100 may be accomplished easily and quickly and without having to move the Auto Rack car 100 into a maintenance shop. FIGS. 8-11 illustrate configurations for an Auto Rack car 100 during a transition from a Tri-level configuration to a Bi-level configuration, but one of ordinary skill in the art would appreciate that the reverse process will reconfigure the Auto Rack car 100 from a Bi-level configuration to a Tri-level configuration. As disclosed herein, reconfiguring the Auto Rack car 100 in the contemplated manner may prevent the Auto Rack car 100 from being taken out of service. Further, the Auto Rack car 100 may be reconfigured without expensive moves and may be reconfigured as frequently as needed to maximize loading efficiency.

For clarity, certain elements of Auto Rack car 100 have been omitted from FIGS. 8-11. For example, structures that support decks 102B or 102C within Auto Rack car 100 have been omitted. As described previously, decks 102B and 102C are supported within Auto Rack car 100 by various structures such as Ball screws, travelling nuts, pulleys, tensions elements, fasteners, couplers, etc. For example, decks 102B and 102C may be supported by Ball screws coupled to Auto Rack car 100 and travelling nuts operably coupled to the Ball screws. As another example, decks 102B and 102C may be supported by pulleys coupled to Auto Rack car 100 and tension elements operably coupled to the pulleys. As yet another example, decks 102B and 102C may be supported by fasteners and couplers that couple decks 102B and 102C to a sidewall of Auto Rack car 100.

Figure 8:
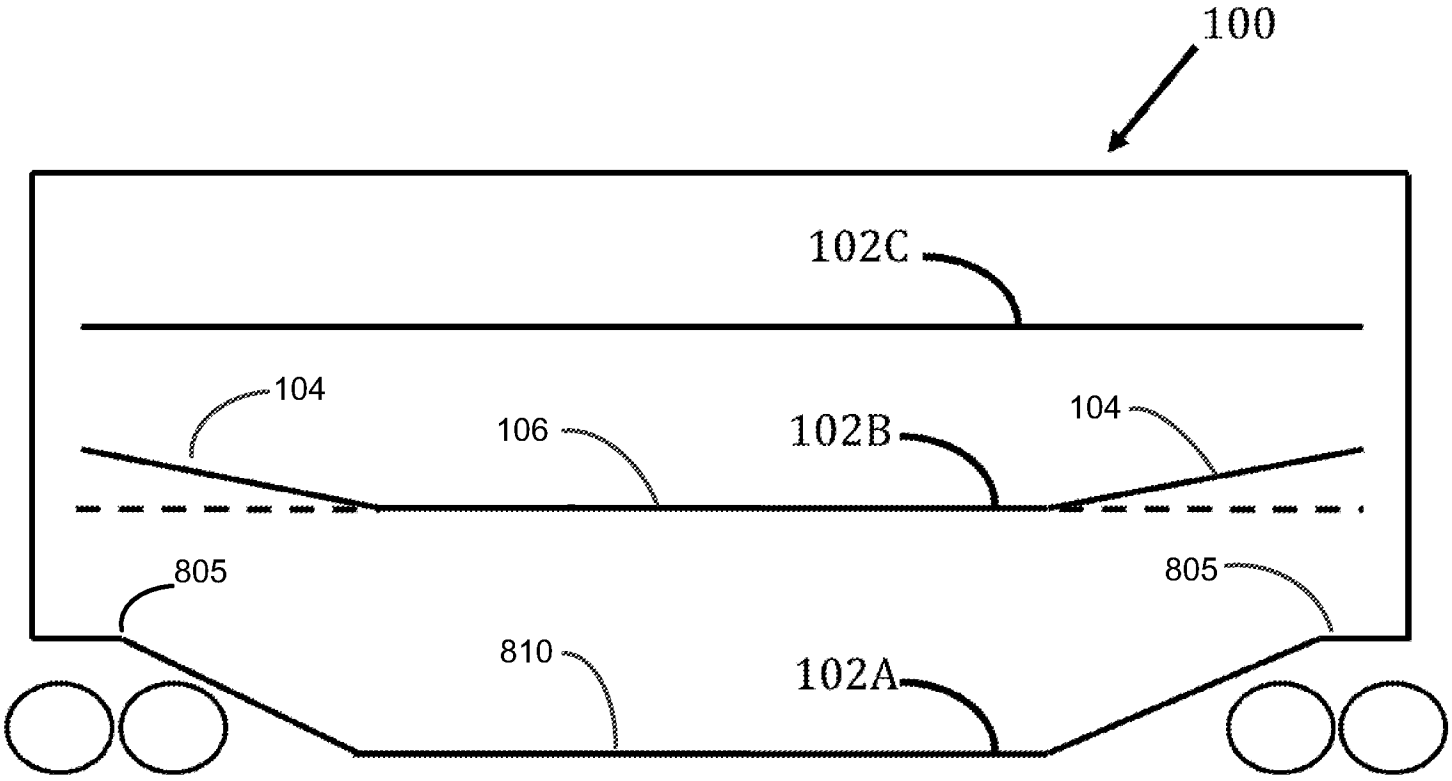
FIGS. 8-11 are cutaway side views of an embodiment of deck configurations in an Auto Rack car.

FIG. 8 illustrates a Tri-level Auto Rack car 100 with three decks designated A-deck 102A, B-deck 102B, and C-deck 102C. The A-deck 102A is the bottom-most deck and may be of a style known as a "low level" or "well" design. As shown in FIG. 8, the floor of the A-deck 102A in the middle of the Auto Rack car 100 is a well region 810 that is below and between floor regions 805. Well region 810 and floor regions 805 may also be referred to as well section 810 and floor sections 805, respectively.

The A-deck 102A may be supported by a flatcar in one embodiment. For example, floor regions 805 may rest on a flatcar and well region 810 may extend below the flatcar. In another embodiment, A-deck 102A may be a flatcar that is configured with floor regions 805 and well region 810. The sidewalls and roof of Auto Rack car 100 may be positioned on the flatcar/A-deck 102A.

The B-deck 102B includes a center portion 106 with portions 104 of the deck on each opposite end that are hinged. The hinged portions 104 of the B-deck 102B may be pivoted upward to provide sufficient clearance for loading vehicles onto the A-deck 102A below it and/or into the well region 810 of the A-deck 102A. After the A-deck 102A is loaded, the hinged portions 104 of the B-deck 102B are lowered into a position that results in the B-deck 102B being flush from one end of the Auto Rack car 100 to the other. The C-deck 102C may or may not have similar hinged sections on each end. Hinged portions on a C-deck 102C may be smaller than the hinged portions 104 on the B-deck 102B.

Figure 9:
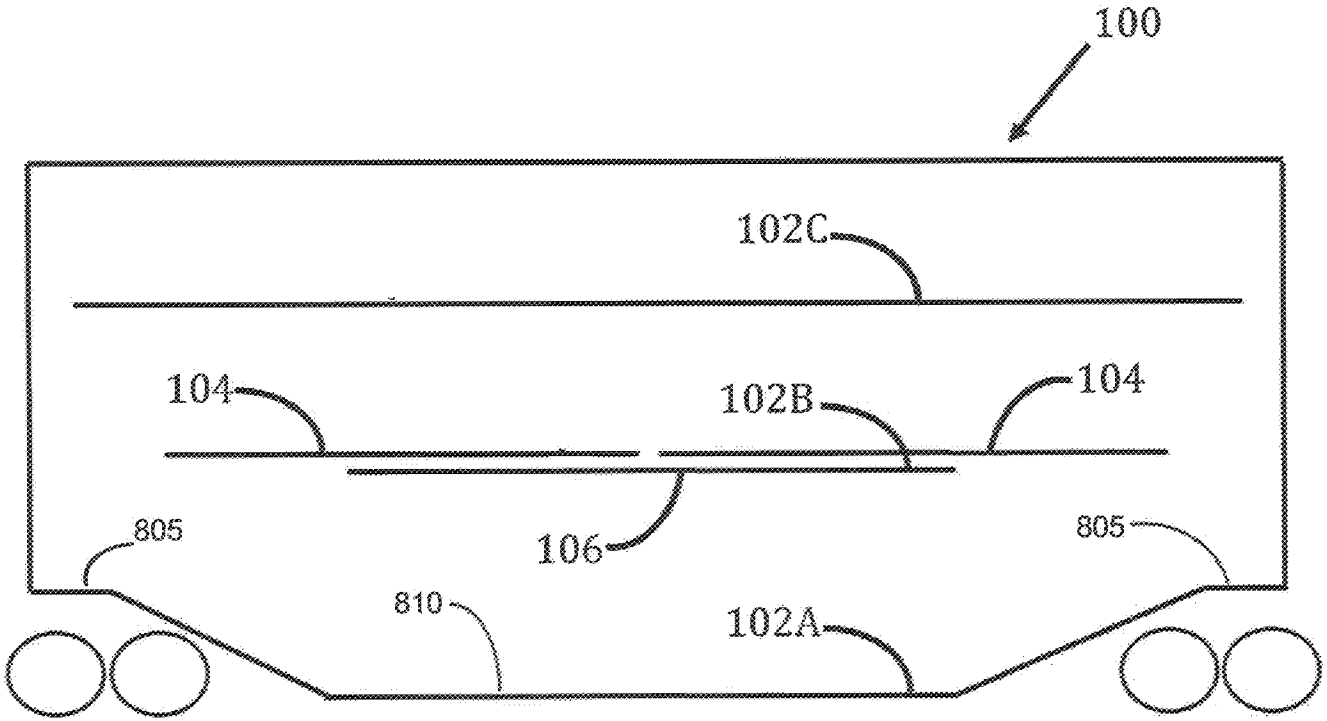
Figure 10:
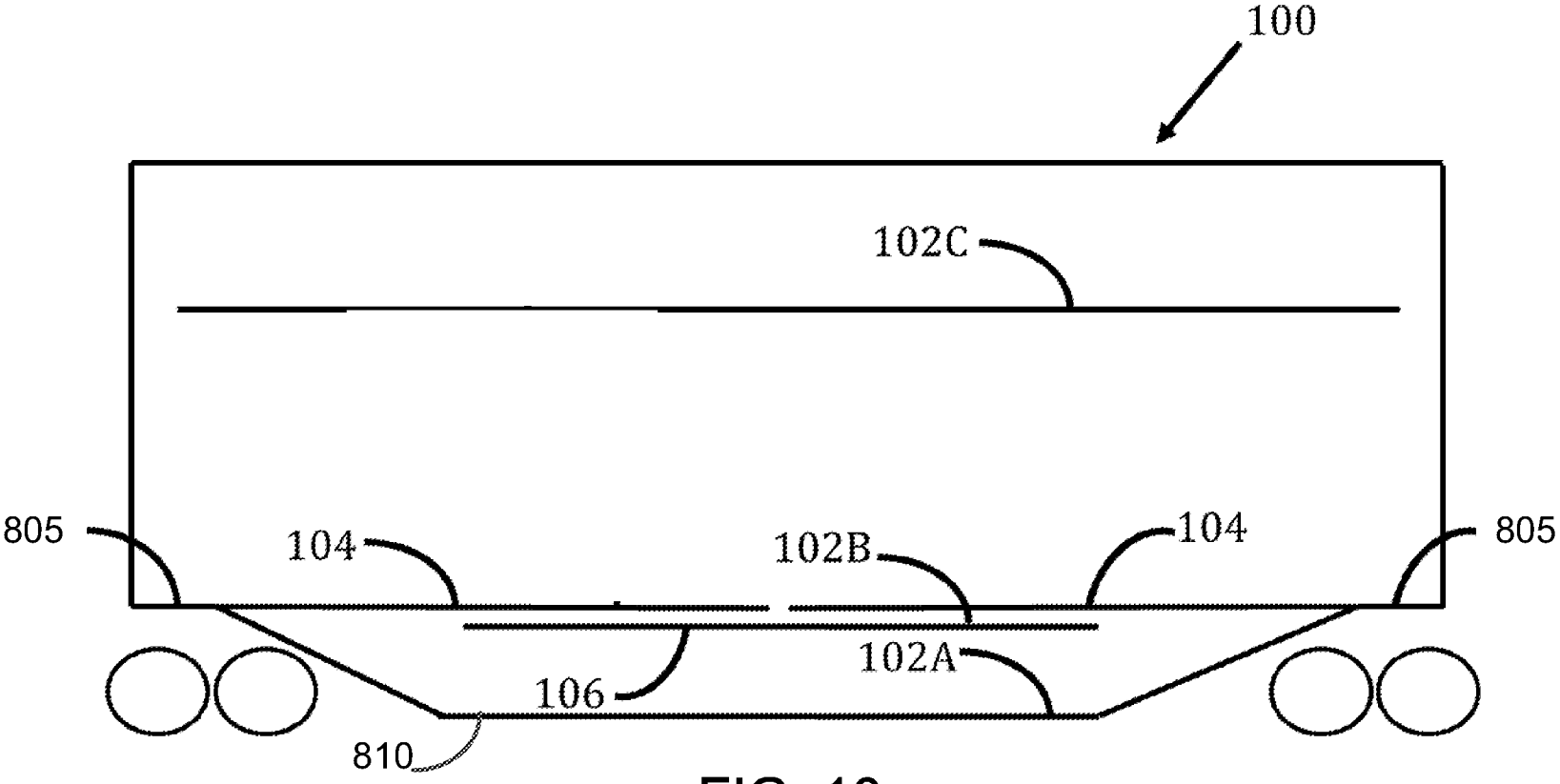

The B-deck 102B may be shortened to allow it to be lowered onto the well region 810 of the A-deck 102A. For example, the hinged portions 104 of the B-deck 102B may be raised up and moved (e.g. slid) inward toward the center of the center portion 106 of the B-deck 102B such that the center portion 106 may be positioned above or below portions 104. An example of this configuration is shown in FIG. 9. By shortening the B-deck 102B, it becomes possible to lower the B-deck 102B onto the well region 810 of the A-deck 102A such that the portions 104 of the B-deck 102B are substantially flush with the floor regions 805 of the A-deck 102A and such that the center portion 106 sits within the well region 810. In one embodiment, portions 104 are substantially flush with floor regions 805 of A-deck 102A when a vehicle can drive over floor regions 805 onto portions 104. In an embodiment, portions 104 are substantially flush with floor regions 805 of A-deck 102A when a vertical position of the portions 104 of the B-deck 102B is within approximately half an inch of the vertical position of the floor regions 805. In one embodiment, portions 104 are substantially flush with floor regions 805 of A-deck 102A when a vertical position of the portions 104 of the B-deck 102B is over approximately an inch higher or lower than the vertical position of the floor regions 805. FIG. 10 shows the B-deck 102B lowered such that the portions 104 are substantially flush with the floor regions 805 of the A-deck 102A. In this configuration, the floor regions 805 and the potions 104 form a substantially flat surface on which vehicles can be loaded. In this manner, portions of the A-deck 102A and the B-deck 102B are combined to form one effective deck. As a result, the number of effective decks in Auto Rack car 100 is reduced from three to two.

Figure 11:
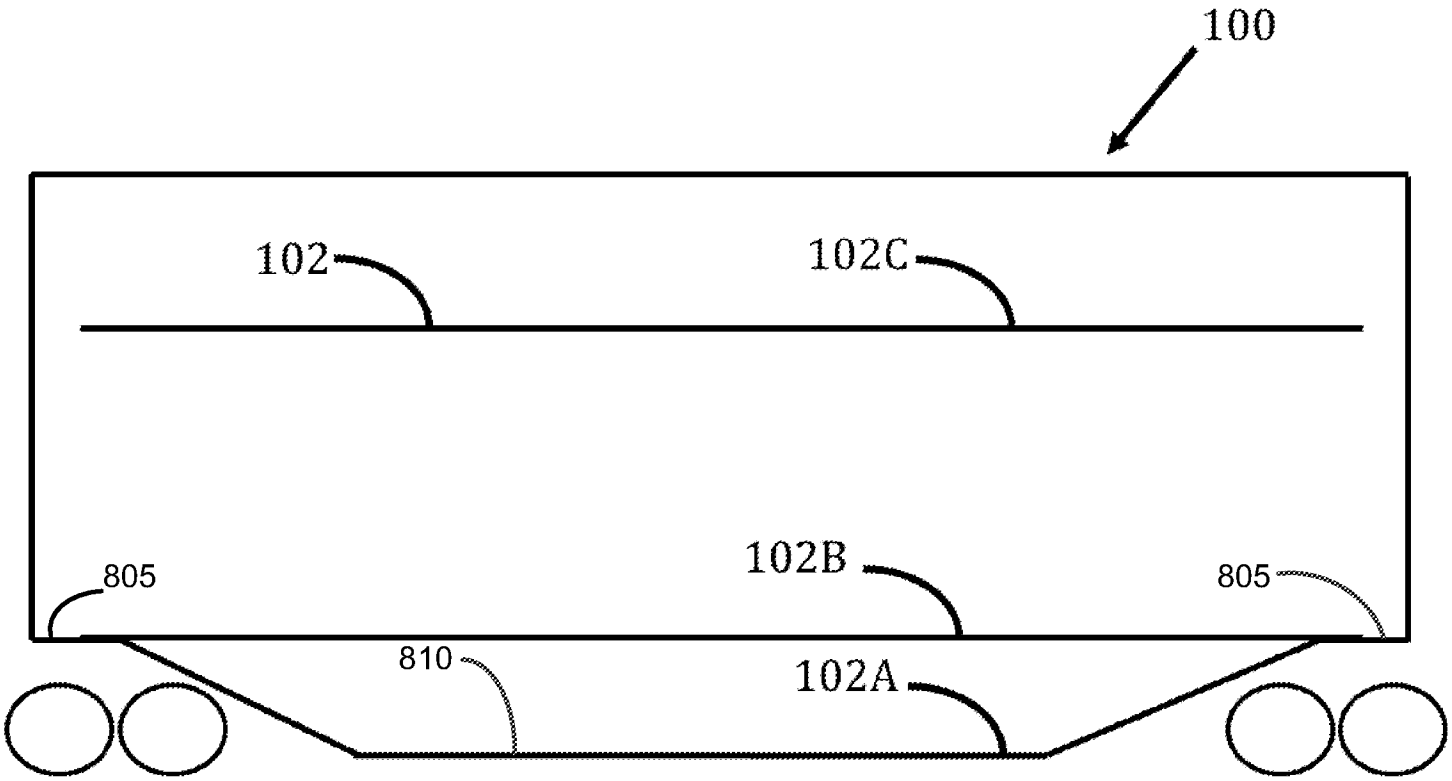

In another embodiment, the B-deck 102B may be positioned such that portions of the B-deck 102B rest on top of floor regions 805 (e.g., B-deck 102B overlaps well region 810 and portions of floor regions 805). An example of this configuration is shown in FIG. 11.

Examples of mechanisms for moving the B-deck 102B include, but are not limited to, cranes, hoists, jacks, cylinders, levers, or any other suitable mechanism as would be appreciated by one of ordinary skill in the art upon viewing this disclosure. In one embodiment, the B-deck 102B may be moved using a Ball screw system that comprises a Ball screw 104, a Ball screw actuator 106, and a travelling nut 108 similar to as describe in FIG. 1. With the Ball screws 104 attached to the upper part of the Auto Rack car 100 structure, the travelling nut 108 that engages the Ball screw 104 threads is attached to the deck to be moved. The travelling nut 108 moves along the axis of the Ball screw 104 with its direction of movement depending upon which direction the Ball screw 104 is turned. Multiple Ball screw systems may be used for increased lifting capacity, redundancy, to keep the deck level, and to provide fine adjustments to location. With the Ball screws 104 supporting the weight of the B-deck 102B, the B-deck 102B may be disconnected from the Auto Rack car 100 structure. The B-deck 102B is lowered onto the A-deck 102A and secured to the Auto Rack car 100 structure. In one embodiment, the travelling nuts 108 may be disconnected from the B-deck 102B and attached to the C-deck 102C. The C-deck 102C may be moved to a new location similarly to as disclosed for the B-deck 102B.

In one embodiment, the Ball screw systems may be permanently attached to one or more decks and configured to lock the decks in position with a brake to keep the Ball screw 104 from rotating. Secondary locks may also be used if desired.

In one embodiment, B-deck 102B and/or C-deck 102C may be moved using a pulley system that includes pulleys coupled to Auto Rack car 100 and tension elements (e.g., strings, ropes, tethers, straps, cables, etc.) operably coupled to the pulleys. The tension elements may further be operably coupled to B-deck 102B and/or C-deck 102C. An operator can adjust a vertical position of B-deck 102B and/or C-deck 102C within Auto Rack car 100 by pulling and/or releasing the tension elements. In an embodiment, the operator can pull and/or release the tension elements by operating a button and/or actuator (e.g., motor) that pulls and releases the tension elements.

Figure 12:
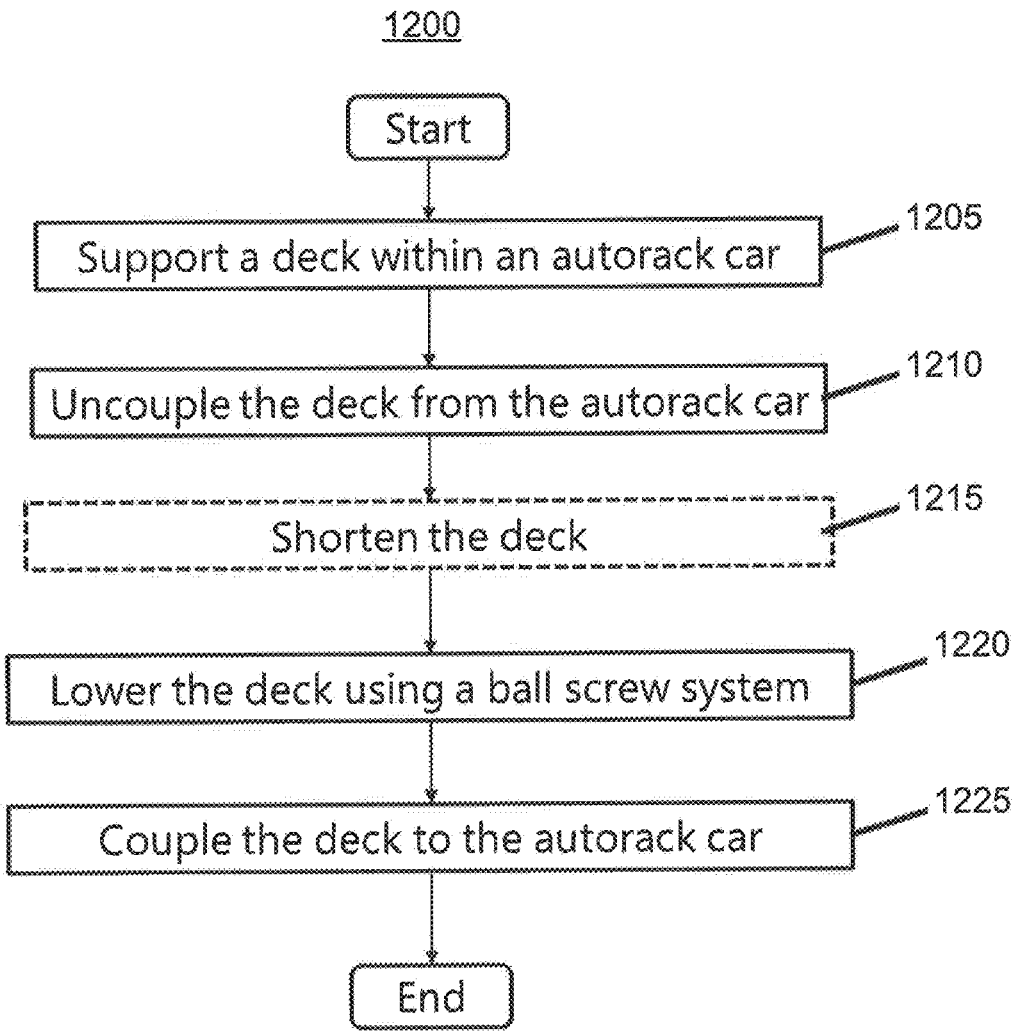
FIG. 12 is a flowchart of an embodiment of a deck reconfiguration method.

FIG. 12 is flowchart of an embodiment of an Auto Rack car reconfiguration method 1200. Method 1200 may be employed by an operator or technician to convert an Auto Rack car 100 from a Tri-level configuration (three decks) to a Bi-level configuration (two decks). At step 1205, the operator supports a deck (e.g. B-deck 102B) within the Auto Rack car 100. The deck may be supported by a variety of techniques, including, but not limited to, cranes, hoists, jacks, cable hoists, hydraulic or air cylinders, and levers. For example, a crane may be employed to support the weight of the deck to relieve the tension on the fasteners that couple the deck to the Auto Rack car 100. At step 1210, the operator uncouples the deck from the Auto Rack car 100. The operator may remove fasteners (e.g. bolts or pins) that are used to couple the deck to the Auto Rack car 100.

Optionally, at step 1215, the operator may shorten the length of the deck. For example, the operator may remove hinges that couple hinged portion 104 of the deck to a center portion 106 of the deck. The operator may slide the hinged portion 104 inward toward the center of the center portion 106 of the deck, and thereby shorten the length of the deck. The hinged portions 104 may be coupled to the center portion 106 using fasteners or any other suitable technique as would be appreciated by one of ordinary skill in the art upon viewing this disclosure.

At step 1220, the operator lowers the deck using a Ball screw system. The operator may move the deck using a Ball screw system that comprises a Ball screw 104, a Ball screw actuator 106, and a travelling nut 108 similar to as describe in FIG. 1. For example, the operator positions a plurality of travelling nuts 108 to support the deck and to couple the deck to the Ball screw 104. The operator may rotate the Ball screw 104 using a controller 110 and a Ball screw actuator 106 to move the deck vertically along the axis of the Ball screw 104. The operator thereby lowers the deck into a new position. Alternatively, the deck may be lowered using any other suitable technique. In one embodiment, the deck may be lowered in a well portion of a lower deck (e.g. the A-deck 102A) when the length of the deck is shortened. In another embodiment, the deck may be lowered onto the surface of a lower deck. At step 1225, the operator couples the deck to the Auto Rack car 100. The operator may use fasteners (e.g. bolts or pins) to couple the deck to the Auto Rack car 100.

When decks (e.g., C-deck 102C) of an Auto Rack car 100 are adjusted upwards, the amount of available space between an upper deck and the roof of the Auto Rack car 100 in which vehicles can be stored is reduced. This disclosure contemplates an Auto Rack car 100 with a roof section that has an adjustable height. By operating certain mechanisms within the Auto Rack car 100, the roof section can be raised or lowered. In this manner, the Auto Rack car 100 can be customized to fit different types of vehicles. Furthermore, the Auto Rack car 100 can be customized to comply with different height regulations for railcars. An embodiment of an Auto Rack car 100 with an adjustable roof section will be described in more detail using FIGS. 13-16.

Figure 13:
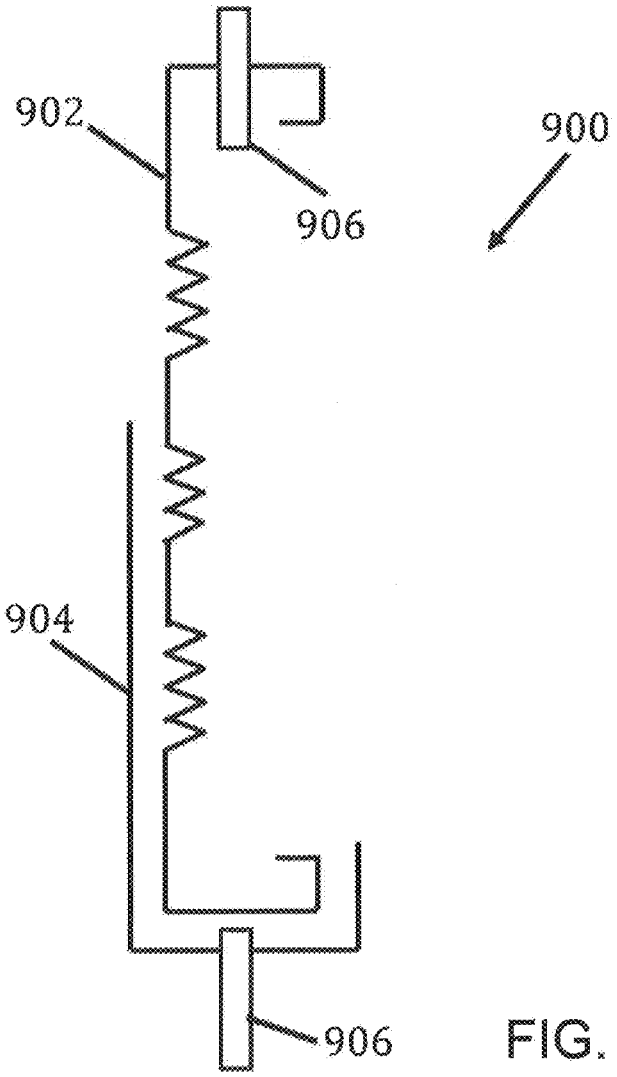
FIG. 13 is a profile view of an embodiment of an adjustable side screen assembly for an Auto Rack car with an adjustable height.
Figure 14:
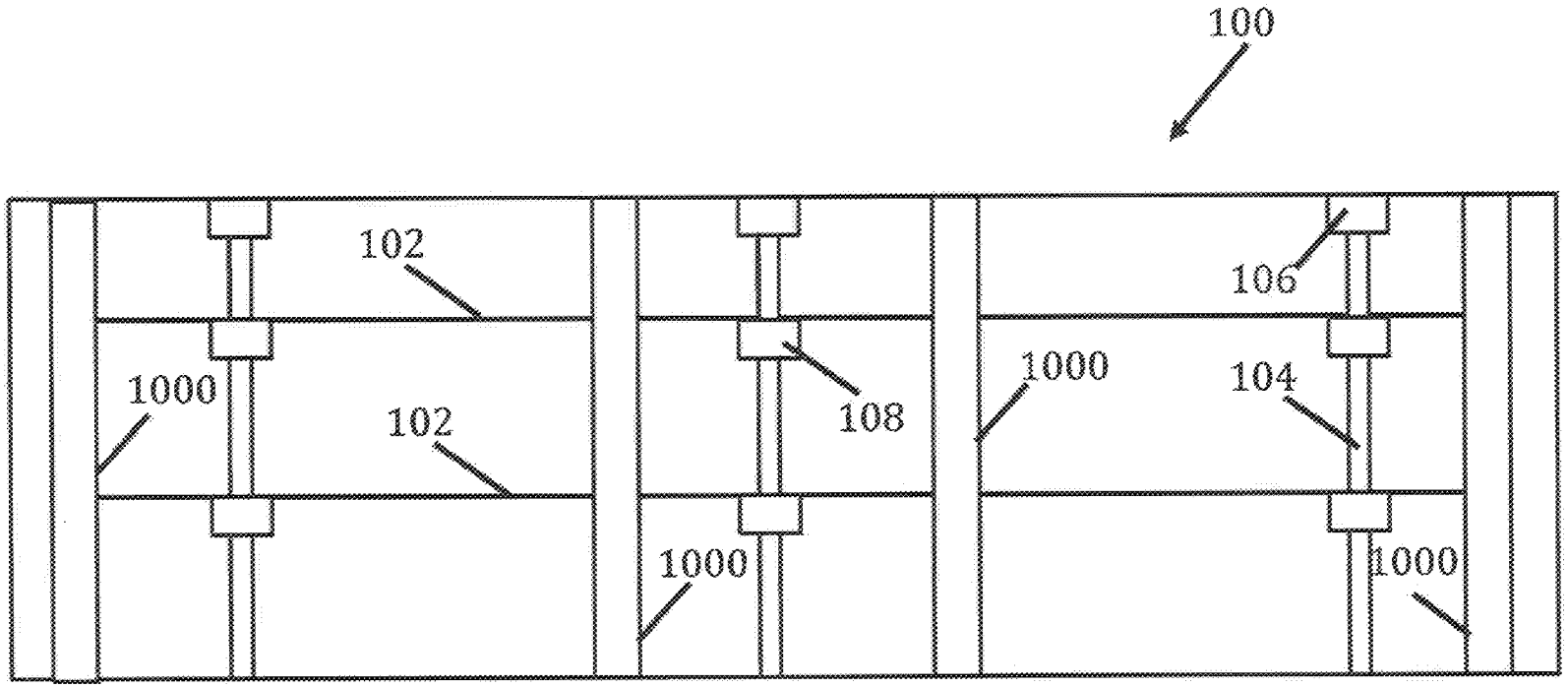
FIG. 14 is a cutaway side view of an embodiment of an Auto Rack car with an adjustable height.
Figure 15:
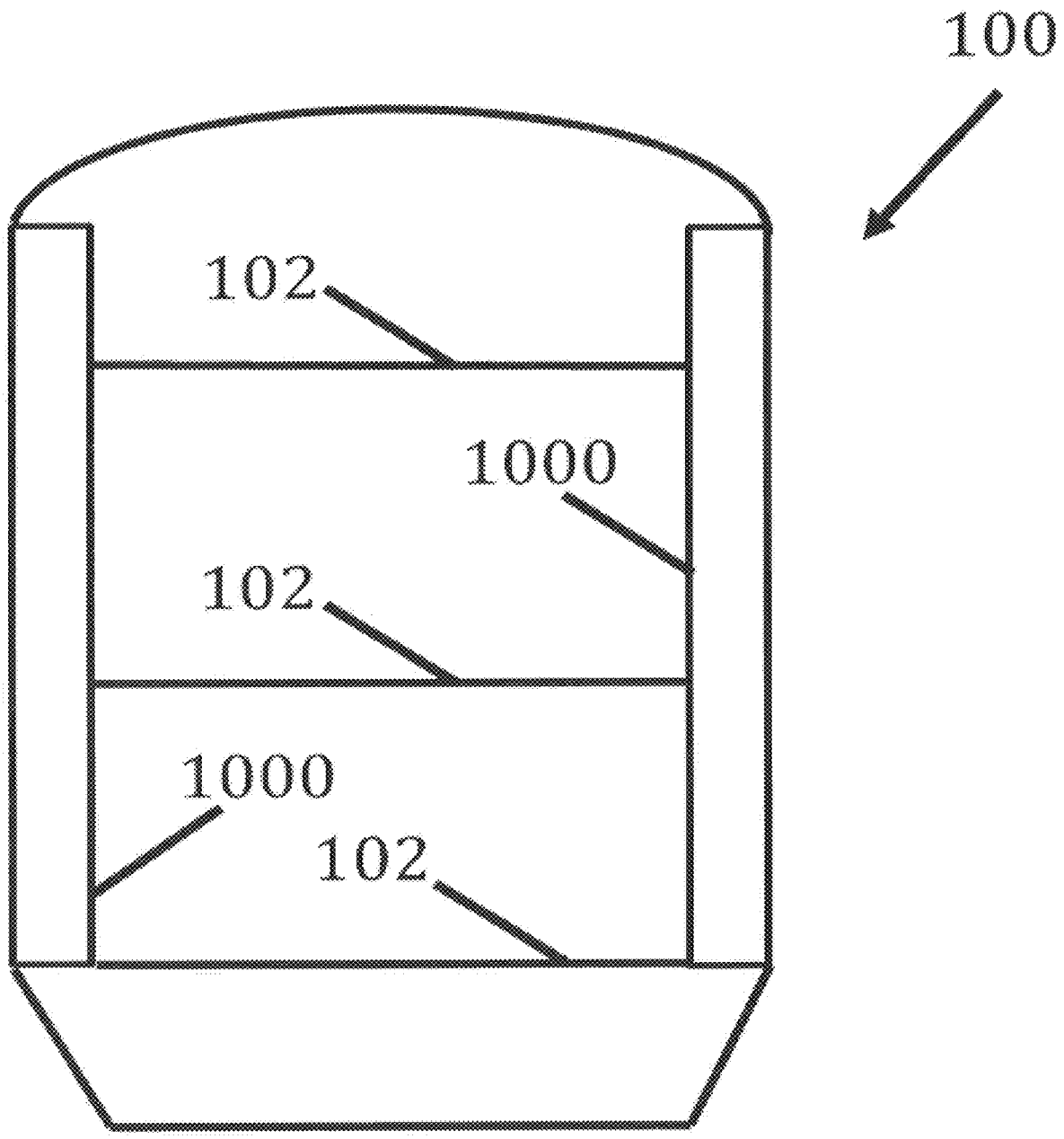
FIG. 15 is a cutaway end view of an embodiment of an Auto Rack car with an adjustable height.

FIG. 13 is a profile view of an embodiment of an adjustable side screen assembly 900 for an Auto Rack car 100 with an adjustable height. FIG. 14 is a profile view of an embodiment of an adjustable side screen assembly for an Auto Rack car with an adjustable height and FIG. 15 is a cutaway end view of an embodiment of an Auto Rack car 100 with an adjustable height. The roof section 1005 may be attached to the Auto Rack car 100 using telescoping posts 1000. Telescopic posts 1000 may be configured such that as the roof 1005 is raised, the telescopic posts 1000 extend to maintain roof support. The telescoping posts 1000 may be secured into position using a fastener (e.g. bolts or pins) once properly positioned at the desired roof height. The roof section 1005 of Auto Rack car 100 may be raised using any suitable technique as would be appreciated by one of ordinary skill of the art upon viewing this disclosure. For example, techniques for raising the roof 1005 include, but are not limited to, a hoist, a crane, a jack, cylinders, a chain/cable hoist, gears, air bags, and levers. In one embodiment, the roof section 1005 is moved using a Ball screw system that comprises a Ball screw 104, a Ball screw actuator 106, and a travelling nut 108 similar to as describe in FIG. 1. For example, a series of Ball screw actuators 106 may be mounted to the roof section of the Auto Rack car 100. The Balls screws 104 are turned by the Ball screw actuators 106 using a gear reduction and electric motor. Multiple Ball screw systems may be used to provide sufficient lifting capacity, redundancy if there is a mechanical failure, and to keep the roof section 1005 level as it is raised or lowered. By mounting the Ball screw system to the roof section 1005 and attaching the traveling nut 108 to the deck 102B or 102C or Auto Rack car 100 structure below, the roof 1005 can be raised or lowered when the telescoping posts 1000 are unfastened, which allows the telescopic posts 1000 to telescope when the Ball screws 104 are turned. Once the roof section 1005 is in the proper position, the telescoping posts 1000 are fastened into position and the Ball screws 104 may be disconnected from the deck 102B or 102C or Auto Rack car 100 structure.

In one embodiment, the roof section 1005 is extended by adding roof panels to the roof section 1005. These roof panels may be telescoping roof panels that extend downwards towards Auto Rack car 100.

After changing the height of the Auto Rack car 100, the individual deck (e.g. A-deck 102A, B-deck 102B, and C-deck 102C) heights may need to be adjusted, for example, by a few inches, to maximize vehicle loading efficiency. In one embodiment, the decks may be moved using a Ball screw system similarly to as describe above. For example, with the Auto Rack side posts bolted into position and the Ball screw system is attached to the roof structure, the travelling nuts 108 may be attached to a deck that needs to be relocated. Once the Ball screws 104 and the travelling nut 108 are supporting the weight of the deck, the deck can be unbolted from the Auto Rack car 100, raised or lowered as needed to the new location using the Ball screws 104, and bolted into position. This process may be performed on both the B-deck 102B and C-deck 102C of the Auto Rack car 100.

The entry doors at the ends of the Auto Rack car 100 may need to be changed or modified when the height of the Auto Rack car 100 changes. For example, when raising the Auto Rack car 100 height from 19 feet to about 20 feet 2 inches, an additional 14 inches of door should be provided. Examples of technique for changing or modifying entry doors includes, but are not limited to, exchanging the entry doors with taller ones, having telescoping panels on the doors, and adding an additional set of door panels to the existing entry doors.

In one embodiment, the overall height of an Auto Rack car 100 may be adjusted as needed. For example, the overall height of the Auto Rack car 100 may be adjustable between 19 feet and about 20 feet 2 inch heights as required. The height of an Auto Rack car 100 may be adjusted to any desired height. The ability to adjust the overall height of an Auto Rack car 100 may provide flexibility for shippers to maximize the use of the Auto Rack car to facilitate shipping vehicles anywhere. Adjusting the height of the Auto Rack car 100 may be accomplished relatively easily and in a short amount of time with minimal special equipment required.

Converting the Auto Rack car 100 from, for example, from 19 feet to about 20 feet 2 inches in height, may involve adding and/or extending side screens to enclose the interior of the Auto Rack car 100, raising the roof, adjusting the deck heights to take advantage of the increased height, and modifying the end doors of the Auto Rack car 100 to enclose the interior and provide security. When changing the height of an Auto Rack car 100 from 19 feet to about 20 feet 2 inches, an additional 14 inches of side screen may be added to enclose and secure the interior of the Auto Rack car 100.

Techniques for extending the height of the side screens include, but are not limited to, adding an additional set of side screens, replacing the existing side screens with screens that are taller (e.g. 14 inches taller), or by having two sets of side screens that overlap (e.g. by more than 14 inches) such that they slip past each other when changing height may be used to increase the height of the side screen. In one embodiment, an adjustable side screen assembly 900 comprises a top side screen 902 and an overlapping side screen 904. Top side screens 902 are a piece of sheet metal with corrugations that are fastened to the Auto Rack car along the top and bottom edges using fasteners 906. An overlapping side screen 904 is configured to overlap the bottom edge of the top side screen 902. The bottom edge of the top side screen 902 may be unfastened from the Auto Rack car while the upper edge remains attached to the roof section of the Auto Rack car 100. The overlapping side screen 904 may be fastened to the side structure of the Auto Rack car 100 using fasteners 906. When the roof of the Auto Rack car 100 is raised, the top side screen 902 will rise up with the roof while the overlapping side screen 904 with remain in place with the side of the Auto Rack car 100. The overlap between the top side screen 902 and the overlapping side screen 904 provide closure and security to the Auto Rack car 100 when the roof is raised. For example, with an overlap between the top side screen 902 and the overlapping side screen 904 of more than 14 inches (e.g. an 18 inch overlap), when the roof is raised 14 inches there will be sufficient overlap between the top side screen 902 and the overlapping side screen 904 to maintain closure and security to the interior of the Auto Rack car 100. When decreasing the height of an Auto Rack car 100, for example, changing from an Auto Rack car 100 height of about 20 feet 2 inches to 19 feet, the top side screen 902 and the overlapping side screen 904 slip past each other to provide closure and security.

Figure 16:
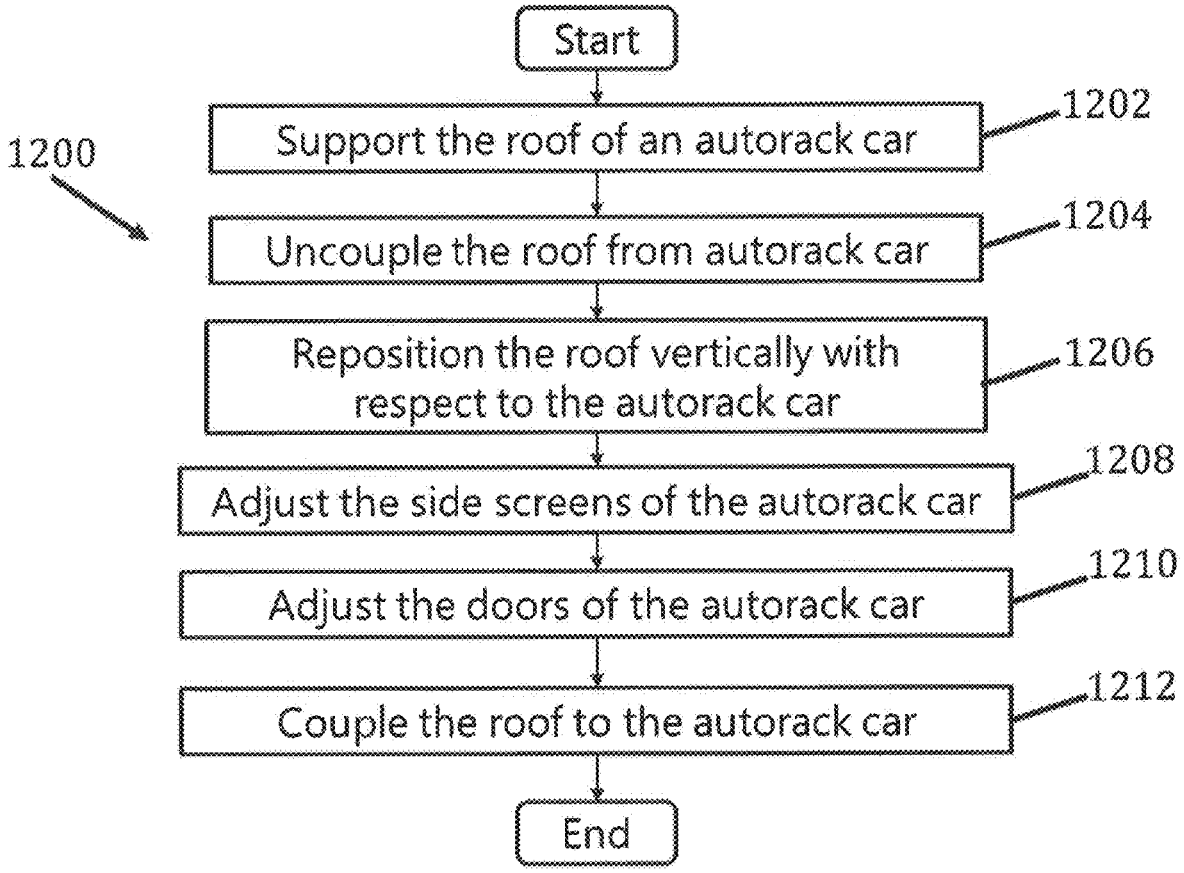
FIG. 16 is a flowchart of an embodiment of a roof height adjustment method.

FIG. 16 is a flowchart of an embodiment of an Auto Rack car 100 height adjustment method 6200. Method 1600 may be employed by an operator or technician to increase or decrease the height of an Auto Rack car 100. At step 1605, the operator supports the roof of the Auto Rack car 100. The roof may be supported by a variety of techniques, including, but not limited to, cranes, hoists, jacks, cable hoists, hydraulic or air cylinders, air bags and levers. For example, a crane may employed to support the weight of the roof and relieve the tension on the fasteners that couple the roof to the Auto Rack car 100. At step 1610, the operator uncouples the roof from the Auto Rack car 100. The operator may remove fasteners (e.g. bolts or pins) that are used to couple the roof to the Auto Rack car 100. For example, the operator may remove fasteners that couple the roof to an adjustable side screen 900 or the operator may uncouple a portion of the adjustable side screen 900 (e.g. the top screen 902) to uncouple the roof from a lower portion (e.g. the base) of the Auto Rack car 100. The operator may also configure telescopic posts 1000 to allow their lengths to be adjusted in response to repositioning the roof. For example, the operator may remove fasteners that are used to lock the telescopic posts 1000 at a particular length.

At step 1615, the operator repositions the roof vertically with respect to the Auto Rack car 100. For example, the operator may increase the height of the roof or lower the height of the roof. In one embodiment, the operator may move the roof using a Ball screw system that comprises a Ball screw 104, a Ball screw actuator 106, and a travelling nut 108 similar to as describe in FIG. 1. For example, the operator positions a plurality of travelling nuts 108 to support the roof and to couple the deck to the Ball screw 104. The operator may rotate the Ball screw 104 using a controller 110 and a Ball screw actuator 106 to move the roof vertically along the axis of the Ball screw 104. The operator thereby raises or lowers the roof into a new position. Alternatively, the roof may be lowered using any other suitable technique. Telescoping posts 1000 within the Auto Rack car 100 may also adjust their length based on the repositioning of the roof. For example, the telescoping posts 1000 may increase their lengths when the roof height is increase or may decrease their length when the roof height is decreased. Telescoping posts 1000 may be locked at their new length once the roof has been repositioned.

At step 1620, the operator adjusts the side screens of the Auto Rack car 100. For example, the operator may adjust adjustable side screens 900, if present, or may exchange the original side screens with taller or shorter side screens. At step 1625, the operator adjusts the doors of the Auto Rack car 100. Examples of technique for adjusting the doors includes, but are not limited to, exchanging the doors with taller or shorter doors, having telescoping panels on the doors, and adding or removing a set of door panels to the existing entry doors. At step 1630, the operator couples the roof to the Auto Rack car 100. The operator may use fasteners (e.g. bolts or pins) to couple the roof to the Auto Rack car 100.

When vehicles are loaded and/or transported in Auto Rack car 100, the vehicles may contact the interior side walls of Auto Rack car 100 causing damage to the vehicle. Existing Auto Rack cars include door guards fastened to their interior side walls that protect vehicles from contacting the side walls. However, these door guards are difficult to adjust and/or remove once positioned because they are fastened to the side wall. This disclosure contemplates a door guard that includes a fabric that couples to the side wall of a railcar by magnets. Cushions are then coupled to the fabric (e.g., by Velcro-hook and loop fasteners, sewn, adhesive, mechanical fasteners, etc.). In this manner, the fabric is easily adjusted by moving magnets on the surface of the side wall. Furthermore, the cushions are easily adjusted by detaching and re-attaching the cushions to the fabric.

Figure 17:
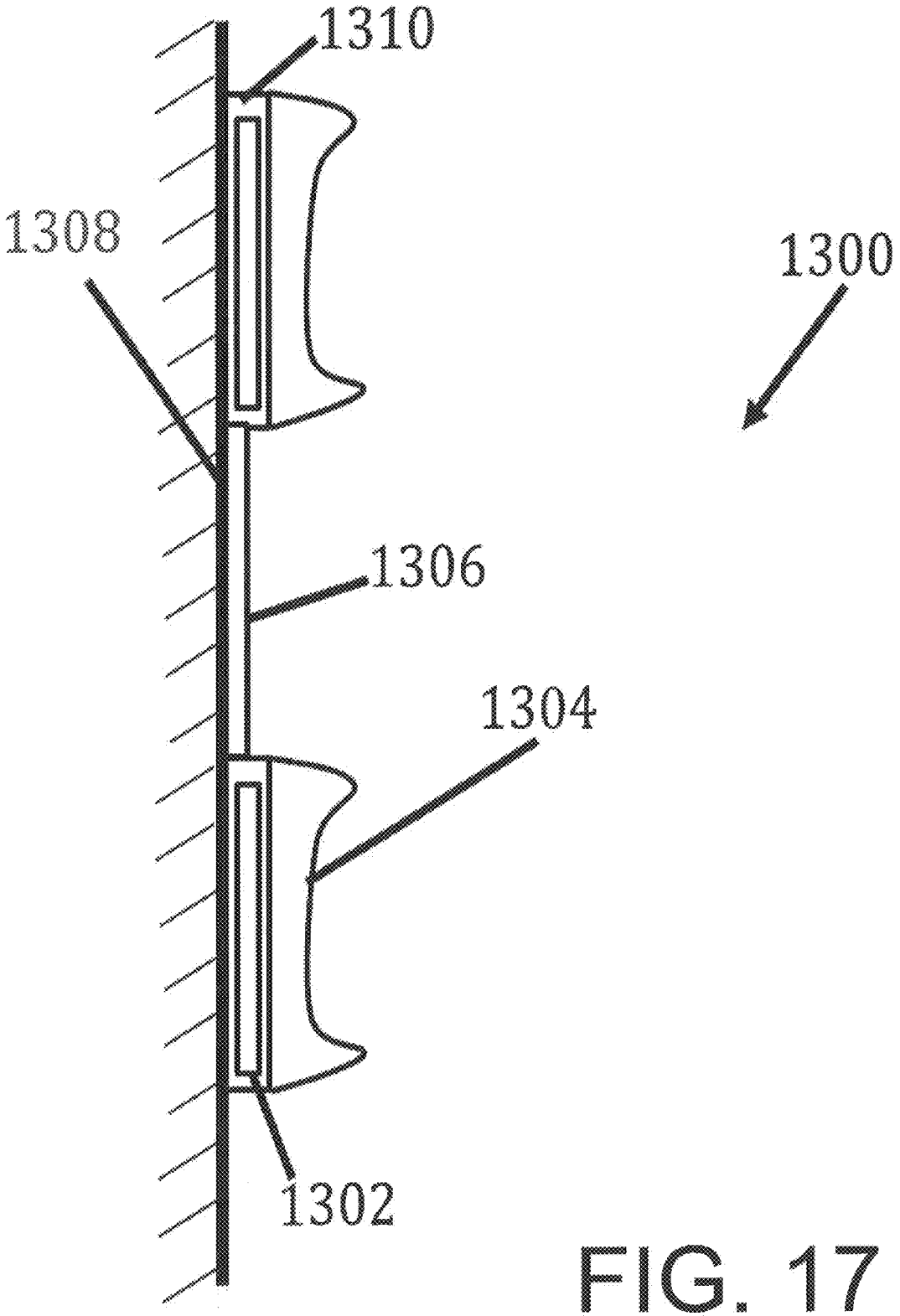
FIG. 17 is a cross section view of an embodiment of a magnetic door edge guard assembly.

FIG. 17 is a cross-section view of an embodiment of a magnetic door edge guard assembly 1300. In one embodiment, a magnetic door edge guard assembly 1300 comprises one or more magnets 1302 sewn into pockets 1310 or otherwise attached to a fabric 1306. The magnets 1302 are configured to hold the fabric 1306 to the sides 1308 of the Auto Rack car 100 using a magnetic coupling. The magnetic door edge guard assembly 1300 further includes protective door guard strips 1304 (e.g., cushions) attached to the fabric 1306. The protective door guard strips 1304 may be attached to the fabric 1306 by bonding, for example, with Velcro, mechanically fastened, or any other suitable technique as would be appreciated by one of ordinary skill in the art upon viewing this disclosure. The protective door guard strips 1304 may be formed of any suitable material (e.g., foam and/or plastic) and may be configured with any suitable shape. Strips 1304 may deform to absorb energy from a vehicle door impact so that the door is not damaged by the impact. The magnetic door edge guard fabric 1306 may be made from a variety of materials. For example, the fabric 1306 may include reflective materials (e.g., reflective nylons), similar to that used on safety vests, may be used to provide guidance to drivers of the vehicles. The fabric 1306 may be configured to reflect the vehicle headlights back to the driver to provide guidance through the length of the Auto Rack car 100 when loading in dark conditions. The reflective material may also be used to help illuminate a work area where the wheel chocks are positioned behind the wheels of vehicles by reflecting light from vehicle head lights and/or another light source.

Figure 18:
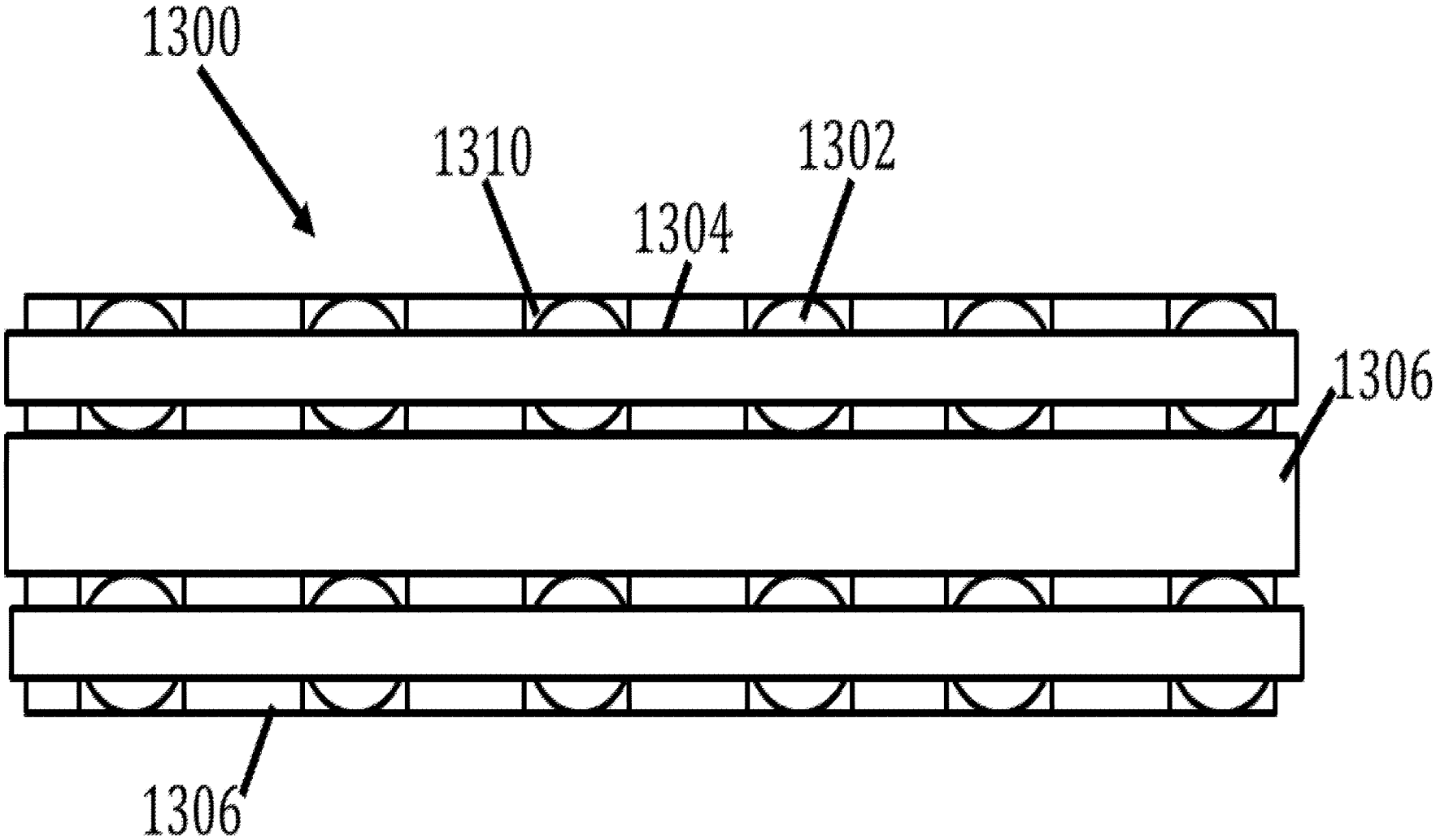
FIG. 18 is a frontal view of an embodiment of a magnetic door edge guard assembly.

FIG. 18 is a frontal view of an embodiment of a magnetic door edge guard assembly 1300. In one embodiment, the magnets 1302 may be configured into two rows. A first row across the top of the magnetic door edge guard assembly 1300 and a second row across the bottom of the magnetic door edge guard assembly 1300 to ensure security. In other embodiments, the magnetic door edge guard assembly 1300 may be formed with a single row. The magnets 1302 may be spaced based on the strength of their magnetic field through the fabric 1306 to the steel side 1308 of the Auto Rack car 1300 to provide sufficient holding power. The door guard strips 1304 (e.g., cushions) may be attached to fabric 1306 across the rows of magnets 1302. This disclosure contemplates the door guard strips 1304 coupling to any appropriate portion of fabric 1306. This disclosure further contemplates door edge guard assembly 1300 including any number of rows of magnets 1302 and strips 1304 (e.g., one, two, three, or more rows).

Magnetic door edge guard assemblies 1300 may be arranged with any suitable length. For example, magnetic door edge guard assemblies 1300 may be constructed in short lengths of a few feet or in one length that extends the entire length of the Auto Rack car 100, for example, eighty feet or more (e.g. eighty five feet or ninety or more feet). Magnetic door edge guard assemblies 1300 with shorter lengths provide the flexibility to locate various sections at different heights and to accommodate differing vehicle sizes when the Auto Rack car 100 is loaded with a mix of different vehicles such as pickup trucks and small cars on the same deck. The flexibility of the design allows the magnetic door edge guard assembles 1000 to be molded around interior posts within the Auto Rack car 100 to provide up to 100% coverage of the Auto Rack car 100 side walls 1308. Any combination of short length and long length magnetic door edge guards 1300 may be used within an Auto Rack car 100.

This disclosure contemplates door edge guard assembly 1300 including multiple cushions smaller than strips 1304 spread across the length of door edge guard assembly 1300. Each cushion would protect vehicles in Auto Rack car 100. By using smaller cushions instead of a larger strip 1304, door edge guard assembly 1300 is more versatile and can be easily customized to accommodate vehicles of various sizes.

Figure 19:
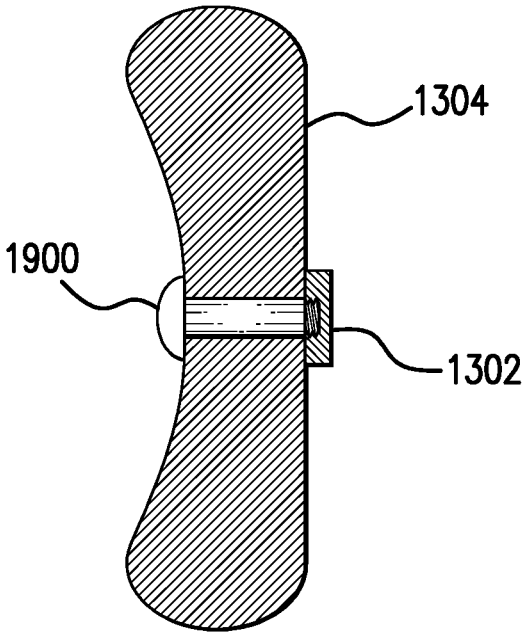
FIG. 19 shows a front view and an end view of an embodiment of a magnetic door edge guard assembly.
Figure 19:
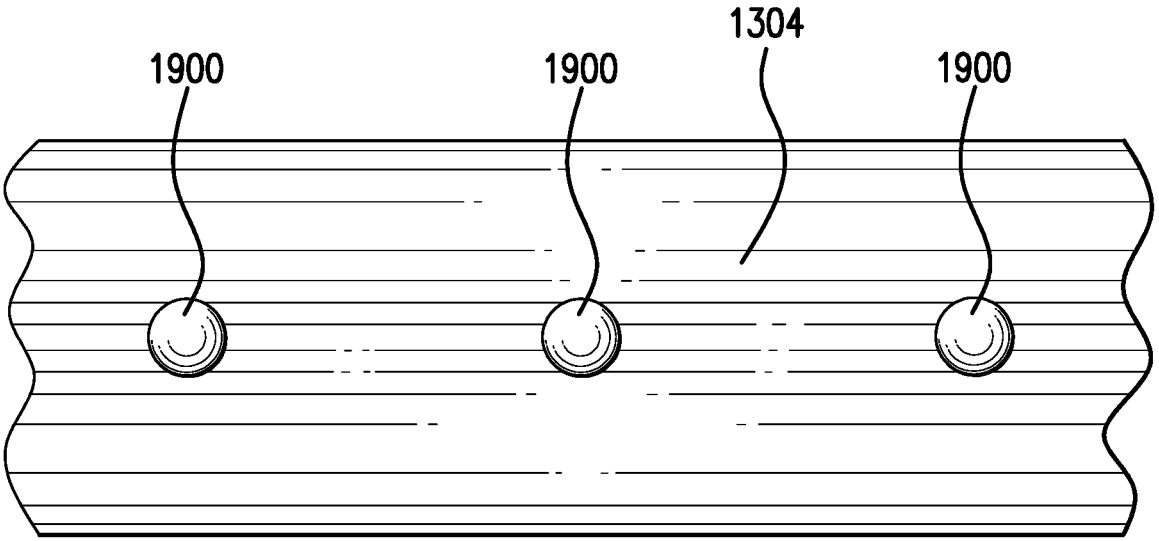

In one embodiment, fabric 1306 is removed and magnets 1302 are attached directly to cushions and/or strips 1304 so that cushions and/or strips 1304 can be attached directly to Auto Rack car 100 without using fabric 1306. As illustrated in FIG. 19, cushion/strip 1304 is coupled to fasteners 1900 that extend through cushion/strip 1304. Fasteners 1900 couple to magnets 1302 on one side of cushion/strip 1304. The magnets 1302 can couple to a side or roof of Auto Rack car 100. Cushion/strip 1304 would extend from the side or roof of Auto Rack car 100 towards the interior of Auto Rack car 100. In this manner, fabric 1306 may be removed.

Figure 20:
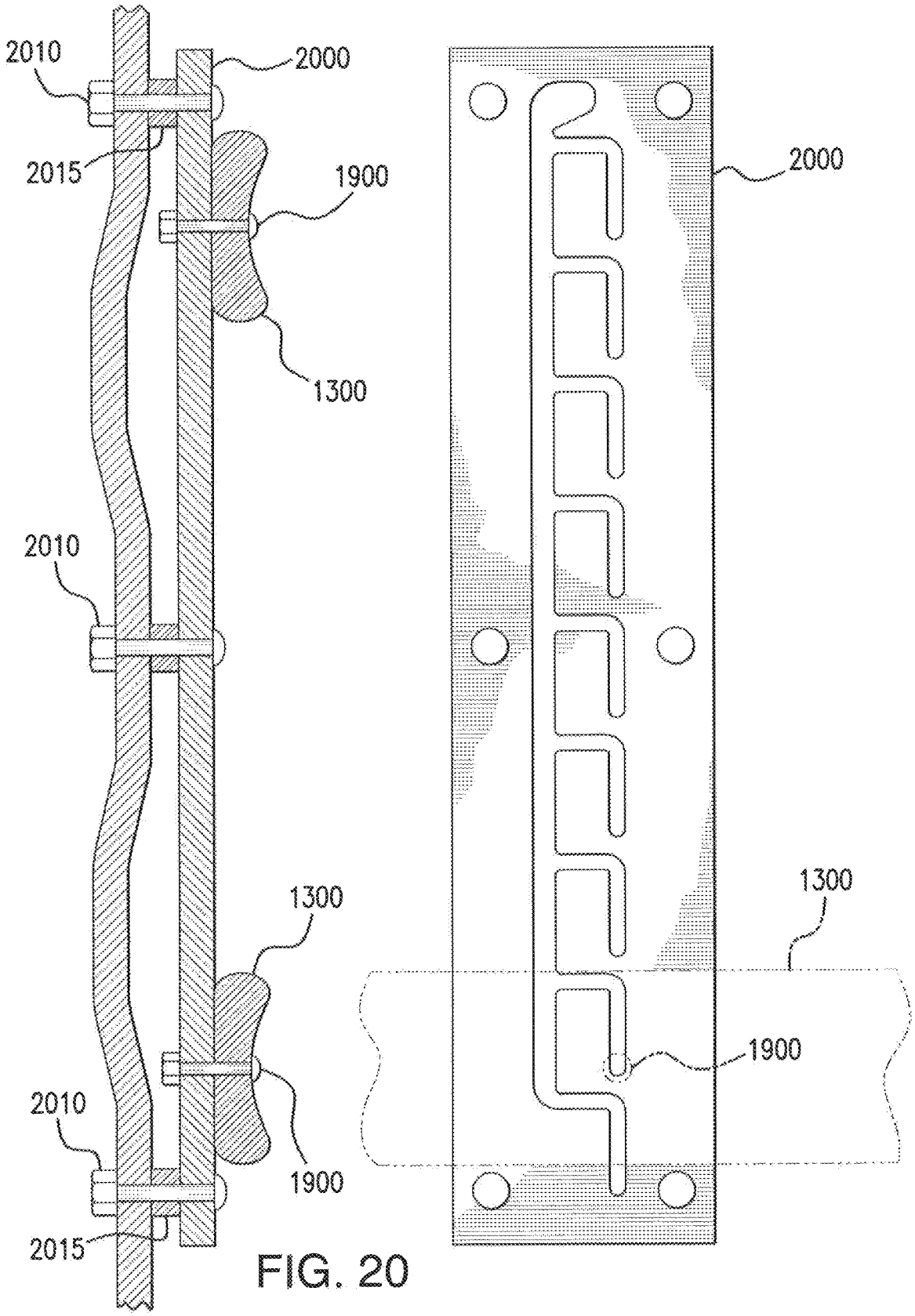
FIG. 20 shows a cross section view and a front view of an embodiment of a door edge guard assembly.

In one embodiment, magnet 1302 is removed and door edge guard 1300 couples to a panel by way of a fastener. As illustrated in FIG. 20, door edge guard 1300 and/or cushion/strip 1304 are coupled to one or more fasteners 1900. Each fastener 1900 extends through door edge guard 1300 and/or cushion/strip 1304. Each fastener 1900 engages a panel 2000. Panel 2000 defines a cavity to which fastener 1900 engages. The cavity may be of any suitable shape. In the illustrated example of FIG. 20, the cavity includes different portions through which fastener 1900 engages. A vertical position of fastener 1900 is adjusted by moving fastener 1900 to different portions of the cavity. In turn, a vertical position of door edge guard 1300 and/or cushion/strip 1304 is also adjusted. Panel 2000 couples to a side screen 2005 of Auto Rack car 100. In the illustrated example of FIG. 20, one or more fasteners 2010 couple panel 2000 to side screen 2005. A standoff 2015 (e.g., a washer) separates panel 2000 from side screen 2005. Cushion/strip 1304 extends from panel 2000 and/or the side wall towards the interior of Auto Rack car 100. In this manner, magnets 1302 may be removed.

When an Auto Rack deck is moved to a new location, the magnetic door edge guard assemblies 1300 may be pulled away from the steel sides 1308 of the Auto Rack car 100 and reattached in the new location. Magnetic door edge guard assemblies 1300 may be designed specific to Auto Rack deck configuration and may be folded or rolled up and stored on the Auto Rack car 100 such that the magnetic door edge guard assembly 1300 stays with the Auto Rack car 100 when Auto Rack cars 100 are converted between Tri-level configurations and Bi-level configurations. In such an example, the appropriate magnetic door edge guard assemblies 1300 are readily available for attachment when the Auto Rack car 100 is later converted back into its previous configuration.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. A method comprising:

coupling a magnetic door guard assembly to an interior surface of a railcar, the magnetic door guard assembly comprising:

a fabric;

a plurality of magnets within the fabric, the plurality of magnets configured to couple the fabric to the interior surface of the railcar; and a cushion coupled to a first portion of the fabric, the cushion overlapping the plurality of magnets, the cushion configured to extend from the fabric towards an interior of the railcar;

decoupling the cushion from the first portion of the fabric;

coupling the cushion to a second portion of the fabric, the second portion different from the first portion; and loading a vehicle into the railcar such that the vehicle aligns with the magnetic door guard assembly.

2. The method of claim 1, further comprising operating a headlight of the vehicle such that the magnetic door guard assembly reflects light back to a driver of the vehicle.

3. The method of claim 1, further comprising:

positioning a wheel chock against the vehicle; and operating a headlight of the vehicle such that the magnetic door guard assembly reflects light back to a portion of the vehicle where the wheel chock is positioned.

4. The method of claim 1, further comprising:

uncoupling the magnetic door guard assembly from the railcar;

folding or rolling the magnetic door guard assembly to produce a compact magnetic door guard assembly;

storing the compact magnetic door guard assembly in the interior of the railcar.

5. The method of claim 1, further comprising:

adjusting a vertical position of a deck of the railcar; and adjusting, based on the vertical position of the deck, a vertical position of the magnetic door guard assembly within the railcar.

6. The method of claim 1, wherein coupling the magnetic door guard assembly to the interior surface of the railcar comprises:

coupling a first portion of the magnetic door guard assembly to the interior surface at a first vertical position; and coupling a second portion of the magnetic door guard assembly to the interior surface at a second vertical position.

* * * * *